US008905624B1

(12) United States Patent
Howe et al.

(10) Patent No.: US 8,905,624 B1
(45) Date of Patent: Dec. 9, 2014

(54) CONTROL OF VIBRATORY/OSCILLATORY MIXERS

(76) Inventors: Harold W. Howe, Butte, MT (US); Peter A. Lucon, Butte, MT (US); Jeffrey D. Thornton, Butte, MT (US); Brian Jay Seaholm, Butte, MT (US)

( * ) Notice: Subject to any disclaimer, the term of this patent is extended or adjusted under 35 U.S.C. 154(b) by 1092 days.

(21) Appl. No.: 12/806,752

(22) Filed: Aug. 20, 2010

Related U.S. Application Data

(60) Provisional application No. 61/274,707, filed on Aug. 20, 2009.

(51) Int. Cl.
*B01F 11/00* (2006.01)
*B01F 11/02* (2006.01)

(52) U.S. Cl.
CPC ..... *B01F 11/0266* (2013.01)
USPC ..... 366/108; 366/111; 366/112; 366/113; 366/114; 366/115; 366/116; 366/117; 366/118; 366/119; 366/123; 366/124; 366/125; 366/126; 366/127; 366/128; 366/208; 366/219; 73/1.82; 73/61.79; 73/64.42; 73/570; 73/645

(58) Field of Classification Search
CPC ..... B01F 11/0266; B01F 11/0283; B01F 2215/0454; B01F 2215/0037; B01F 11/0071; B01F 11/02; B01F 13/0001; B01F 15/00123; B01F 3/0819; B01F 11/0034; B01F 11/0077; B01F 11/0082; B01F 3/088; B01L 2400/0433; B01L 2400/0436; B01L 2400/0439
USPC ..... 73/1.82, 61.79, 64.42, 570, 579, 584, 73/645, 646, 648, 862.59; 366/108, 366/111–119, 123–128, 208–240
See application file for complete search history.

(56) References Cited

U.S. PATENT DOCUMENTS

| | | | | |
|---|---|---|---|---|
| 2,091,414 | A | 8/1937 | Newport et al. | |
| 2,353,492 | A | 7/1944 | O'Connor | |
| 2,636,719 | A | 4/1953 | O'Connor | |
| 3,162,910 | A | 12/1964 | Behnke et al. | |
| 3,498,384 | A | 3/1970 | Ogura | |
| 3,583,246 | A | 6/1971 | Stahle et al. | |
| 3,767,168 | A | 10/1973 | Dupre et al. | |
| 4,142,804 | A | 3/1979 | Crocker | |
| 4,610,546 | A | 9/1986 | Intraub | |
| 4,619,532 | A | 10/1986 | Schmidt | |
| 4,860,816 | A | 8/1989 | Bond | |
| 4,930,898 | A | 6/1990 | Miller-Ihli | |
| 4,972,930 | A | 11/1990 | Davis | |
| 5,033,321 | A | 7/1991 | Gerson | |
| 5,069,071 | A | 12/1991 | McBrien et al. | |
| 5,979,242 | A | 11/1999 | Hobbs | |
| 6,213,630 | B1 | 4/2001 | Kossmann | |
| 6,250,792 | B1 | 6/2001 | Krush et al. | |
| 6,263,750 | B1 | 7/2001 | Maurer et al. | |
| 6,322,243 | B1 * | 11/2001 | Bull | 366/208 |
| 6,431,790 | B1 | 8/2002 | Anderegg et al. | |
| 6,491,422 | B1 | 12/2002 | Rutten et al. | |
| 6,579,002 | B1 | 6/2003 | Bartick et al. | |
| 7,188,993 | B1 * | 3/2007 | Howe et al. | 366/111 |
| 7,270,472 | B2 | 9/2007 | Carreras | |
| 7,481,918 | B2 | 1/2009 | Morrison et al. | |
| 7,726,871 | B2 | 6/2010 | Song et al. | |

(Continued)

*Primary Examiner* — Shogo Sasaki
(74) *Attorney, Agent, or Firm* — Robert M. Hunter

(57) ABSTRACT

A system and method for controlling a mixing system at a peak energy efficiency point, maximum response point or reduced sound generation point based on displacement, velocity, acceleration or jerk operating conditions.

15 Claims, 18 Drawing Sheets

(56) References Cited

U.S. PATENT DOCUMENTS

| | | | | |
|---|---|---|---|---|
| 2002/0118594 | A1 | 8/2002 | Vellinger et al. | |
| 2003/0095470 | A1* | 5/2003 | Afnan et al. | 366/142 |
| 2006/0187743 | A1* | 8/2006 | Carreras | 366/111 |
| 2007/0036025 | A1* | 2/2007 | Friedman | 366/208 |
| 2007/0267351 | A1* | 11/2007 | Roach et al. | 210/695 |
| 2007/0280036 | A1 | 12/2007 | Carreras | |
| 2009/0245015 | A1 | 10/2009 | Ni et al. | |
| 2010/0054076 | A1 | 3/2010 | Itoh et al. | |
| 2010/0254212 | A1* | 10/2010 | Howe et al. | 366/128 |
| 2013/0015114 | A1* | 1/2013 | Paust et al. | 210/198.2 |

* cited by examiner $$V(t) - V_{bemf}(t) = L\frac{d^2}{dt^2}q + R\frac{d}{dt}q + \frac{1}{c}q$$

$$V_{bemf}(t) = K_{bemf}\frac{d}{dt}x$$

$$F(t) = m\frac{d^2}{dt^2}x + b\frac{d}{dt}x + kx$$

$$F(t) = K_f\frac{d}{dt}q$$

| Forcing System | Condition | Relation |
|---|---|---|
| Constant Force System | Maximum Displacement Amplitude | $\omega=\omega_n\sqrt{1-2\zeta^2}$ |
| | Maximum Velocity Amplitude | $\omega=\omega_n$ |
| | Maximum Acceleration Amplitude | $\omega=\frac{\omega_n}{\sqrt{1-2\zeta^2}}$ |
| | Maximum Efficiency | $\omega=\omega_n$ |
| Eccentric Forced System | Maximum Displacement Amplitude | $\omega=\frac{\omega_n}{\sqrt{1-2\zeta^2}}$ |
| | Maximum Velocity Amplitude | $\omega=\omega_n\sqrt{2.0-1.0\sqrt{16.0\zeta^4-16.0\zeta^2+1.0}-4.0\zeta^2}$ |
| | Maximum Acceleration Amplitude | $\omega=\omega_n\sqrt{1.5-0.5\sqrt{36.0\zeta^4-36.0\zeta^2+1.0}-3.0\zeta^2}$ |
| | Maximum Efficiency | $\omega=\omega_n$ |

FIG. 11

CONTROL OF VIBRATORY/OSCILLATORY MIXERS

CROSS-REFERENCE TO RELATED APPLICATIONS

This application claims the benefit of U.S. Provisional Patent Application No. 61/274,707, filed Aug. 20, 2009, the disclosure of which patent application is incorporated by reference as if fully set forth herein, except for the disclosure on page 18, lines 26-29, page 19, lines 1-31, page 20, lines 1-4, and FIGS. 11 and 12 of that patent application.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Grant No. DAAH01-00-C-R086 awarded by the United States Army.

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

This invention relates to control of vibratory/oscillatory mixers and other vibratory/oscillatory systems. In particular, the invention relates to control of such systems at an optimal or peak efficiency point based on displacement, velocity, acceleration, or jerk operating points.

The mixing of fluids involves the creation of fluid motion or agitation resulting in the uniform distribution of either heterogeneous or homogeneous starting materials to form an output product. Mixing processes are called upon to affect the uniform distribution of: miscible fluids such as alcohol in water; immiscible fluids such as the emulsification of oil in water; particulate matter such as the suspension of pigment particles in a carrier fluid; mixtures of dry materials with fluids such as sand, cement and water; thixotropic (pseudo plastic) fluids with solid particulates; the chemical ingredients of pharmaceuticals; biological specimens, such as bacteria, while growing in a nurturing media without incurring physical damage; solid-solid mixing such as dry powders, coating of materials, dispersion of nanoparticles in either dry or wet medias, and reacting mixtures.

Mixing may be accomplished in a variety of ways: rotating impeller(s) mounted on shaft(s) immersed in the fluid mixture agitate(s) the fluid and/or solid materials to be mixed, or a translating perforated plate accomplishes the agitation, or the vessel itself containing the materials is agitated, shaken or vibrated. Mixing may be continuous (as when a rotating impeller is used or the containing vessel is vibrated) or intermittent as when the drive mechanism starts and stops in one or several directions. A static mixer is a type of continuous system that is a flow through device. The continuous flow device may also be vibrated to mix the materials as they flow through.

With a conventional vibrational mixer, the amplitude of mixing can be varied within very narrow limits, and the frequency is generally set at the frequency of the alternating current (AC) power source. Even when using a motor controller with frequency control, the vibrational frequency of a conventional vibrational mixer can be varied only within relatively narrow limits. Mixing at the natural resonant frequency of the mechanism is usually avoided due to the high loads and associated wear of the mechanisms.

The background art is characterized by U.S. Pat. Nos. 4,142,804; 4,610,546; 4,860,816; 4,930,898; 5,033,321; 5,069,071; 6,431,790; 6,491,422; 7,270,472; 7,481,918; and 7,726,871; and U.S. Patent Application Nos. 2002/0118594; 2007/0280036; 2009/0245015; and 2010/0054076; the disclosures of which patents and patent applications are incorporated by reference as if fully set forth herein.

The background art also is characterized by U.S. Pat. Nos. 2,911,192; 2,975,846; 3,004,389; 3,375,884; 3,379,263; 3,461,979; 3,477,237; 3,572,139; 3,633,688; 3,736,843; 3,741,315; 4,150,568; 4,330,156; 4,384,625; 4,693,325; 4,836,299; 4,527,637; 5,004,055; 5,141,061; 5,417,290; 5,540,295; 5,549,170; 5,562,169; 6,129,159; 6,736,209; 6,863,136; 7,191,852; 7,234,537; and 7,341,116; and U.S. Patent Application Nos. 2006/0157280 and 2007/289,778; the disclosures of which patents and patent application are incorporated by reference as if fully set forth herein. The background art is also characterized by WO/2001/83933.

BRIEF SUMMARY OF THE INVENTION

As used herein, the following terms and variations thereof have the meanings given below, unless a different meaning is clearly intended by the context in which such term is used.

"A," "an" and "the" and similar referents used herein are to be construed to cover both the singular and the plural unless their usage in context indicates otherwise.

"About," "approximately," and "in the neighborhood of" mean within ten percent of a recited parameter or measurement, and preferably within five percent of such parameter or measurement.

"Comprise" and variations of the term, such as "comprising" and "comprises," are not intended to exclude other additives, components, integers or steps.

"Exemplary," "illustrative," and "preferred" mean "another."

In illustrative embodiments, the present invention provides a system and method for controlling vibratory/oscillatory systems at an optimal, or peak, efficiency point based on displacement, velocity, acceleration, or jerk operating points. In mixing applications, depending on the type of mixture being mixed, it may be optimal to operate the machine on the highest displacement, velocity, acceleration, or jerk available to the machine. Mixing by a vibratory means, the contents inside are coupling with the mechanical machine and absorbing energy (damping). The amount of energy being absorbed can change during the mixing process, thus a smart method of determining the most efficient operating state, maximum displacement amplitude, maximum velocity amplitude, maximum acceleration amplitude, or maximum jerk amplitude of the vibratory mixing vessel is desirable. However, it may also be advantageous to operate the system at a condition that is not at a maximum. For example, a maximum condition of the above may cause adverse effects on the materials being mixed, damaging them, causing them to over-mix, segregate, preclude bulk mixing, etc., as well as decouple from the mixing container. As such, the velocity, amplitude, acceleration, or jerk amplitude may be adjusted to a non-maximum operating condition. Dynamics of the energy absorbed by the mixing phenomena determine optimal operating conditions. Optimal operating conditions do not always occur at a predetermined phase angle, or phase relationship, between the input force waveform and the system response waveform. In illustrative embodiments, the invention provides a system and process for controlling a mixer and mixing process to an optimized state, or condition, based on various parameters and motion feedback from the device relative to changing characteristics of the material being processed.

In an illustrative embodiment, the invention is a method for controlling a vibratory/oscillatory mixer that comprises an actuator and a mechanical system containing a material to be mixed, the mechanical system being subjected to a plurality of oscillatory input force waveforms and vibrating in accordance with a plurality of associated oscillatory response waveforms, the method comprising: accepting input from an operator of a desired operating condition; operating the actuator at a first oscillatory input force waveform having a first frequency and a first input force amplitude to produce a first associated oscillatory response waveform within a primary mode of resonance in the mechanical system; measuring a first phase angle between said first oscillatory input force waveform and said first associated oscillatory response waveform; controlling the actuator at a second oscillatory input force waveform having a second frequency to produce a second associated oscillatory response waveform; determining a second phase angle between said second oscillatory input force waveform and said second associated oscillatory response waveform; calculating an undamped natural frequency, a damping ratio and operating points for maximum displacement, maximum velocity, maximum acceleration or maximum jerk for said mechanical system; driving the actuator at an operating frequency that causes the mechanical system to vibrate substantially at one of said operating points; repeating said operating, measuring, controlling, determining, calculating and driving steps until the mechanical system is operating at said one of said operating points; increasing said input force amplitude until said desired operating condition is reached; periodically testing the mechanical system to ensure that it is operating at said desired operating condition, and, if the mechanical system is not operating at said desired operating condition, repeating said operating, measuring, controlling, determining, calculating, driving, repeating, increasing and periodically testing steps until the mechanical system is operating at said desired operating condition; during operation at said desired operating condition, calculating the amount of energy and/or power being absorbed by the material to be mixed; during operation of said mechanical system, executing a supervisory algorithm; and terminating mixing.

In another illustrative embodiment, the invention is a method for controlling a vibratory/oscillatory mixer that comprises an actuator and a mechanical system containing a material to be mixed, the mechanical system being subjected to a plurality of oscillatory input force waveforms and vibrating in accordance with a plurality of associated oscillatory response waveforms, the method comprising: (a) accepting input from an operator of a desired mixer operating condition; (b) operating the actuator at a first oscillatory input force waveform having a first frequency and a first input force amplitude to produce a first associated oscillatory response waveform within a primary mode of resonance in the mechanical system; (c) measuring a first phase angle between said first oscillatory input force waveform and said first associated oscillatory response waveform; (d) operating the actuator at a second oscillatory input force waveform having a second frequency to produce a second associated oscillatory response waveform; (e) measuring a second phase angle between said second oscillatory input force waveform and said second associated oscillatory response waveform; (f) calculating an undamped natural frequency, a damping ratio and operating points for maximum displacement, maximum velocity, maximum acceleration or maximum jerk for said mechanical system; (g) operating the actuator at an operating frequency that causes the mechanical system to vibrate substantially at one of said operating points; (h) repeating steps (b) through (g) until the mechanical system is operating at said one of said operating points; (i) increasing said input force amplitude until said desired operating condition is reached; (j) periodically testing the mechanical system to ensure that it is operating at said desired operating condition, and, if the mechanical system is not operating at said desired operating condition, repeating steps (b) through (j) until the mechanical system is operating at said desired operating condition; (k) during operation at said desired operating condition, calculating the amount of energy and/or power being absorbed by the material to be mixed; (l) during operation of said mechanical system, executing a supervisory algorithm; and (m) terminating mixing.

In another illustrative embodiment, the invention is a method for controlling a vibratory/oscillatory mixer at a desired operating condition, the vibratory/oscillatory mixer comprising an actuator and a mechanical system containing a material to be mixed, the mechanical system being subjected to a plurality of oscillatory input force waveforms and vibrating in accordance with a plurality of associated oscillatory response waveforms, the method comprising: operating the actuator at a first oscillatory input force waveform having a first frequency and a first input force amplitude to produce a first associated oscillatory response waveform within a primary mode of resonance in the mechanical system; measuring a first phase angle between said first oscillatory input force waveform and said first associated oscillatory response waveform; operating the actuator at a second oscillatory input force waveform having a second frequency to produce a second associated oscillatory response waveform; measuring a second phase angle between said second oscillatory input force waveform and said second associated oscillatory response waveform; calculating an undamped natural frequency, a damping ratio and operating points for said mechanical system; operating the actuator at an operating frequency that causes the mechanical system to vibrate at one of said operating points; increasing said input force amplitude until said desired operating condition is reached; and ensuring that the mechanical system is operating at said desired operating condition. In another illustrative embodiment, the method further comprises: during operation at said desired operating condition, calculating the amount of energy or power being absorbed by the material to be mixed.

In another illustrative embodiment, the invention is a system for controlling a vibratory/oscillatory mixer at a desired operating condition, the vibratory/oscillatory mixer comprising an actuator and a mechanical system containing a material to be mixed, the mechanical system being subjected to a plurality of oscillatory input force waveforms and vibrating in accordance with a plurality of associated oscillatory response waveforms, the system comprising: means for operating the actuator at a first oscillatory input force waveform having a first frequency and a first input force amplitude to produce a first associated oscillatory response waveform within a primary mode of resonance in the mechanical system; means for measuring a first phase angle between said first oscillatory input force waveform and said first associated oscillatory response waveform; means for operating the actuator at a second oscillatory input force waveform having a second frequency to produce a second associated oscillatory response waveform; means for determining a second phase angle between said second oscillatory input force waveform and said second associated oscillatory response waveform; means for calculating an undamped natural frequency, a damping ratio and operating points for said mechanical system; means for operating the actuator at an operating frequency that causes the mechanical system to vibrate at one of said operating points; means for increasing said input force amplitude until said desired operating condition is reached; and means for ensuring that the mechanical system is operating at said desired operating condition. In another illustrative embodiment, the system further comprises: means for calculating the amount of energy or power being absorbed by the material to be mixed during operation at said desired operating condition.

In another illustrative embodiment, the invention is a system for controlling a vibratory/oscillatory mixer at a desired operating condition, the system comprising: a mechanical system that is operative to contain a material to be mixed; an actuator; a sensor; and a controller; wherein said controller is operative to cause said actuator to impose a first oscillatory input force waveform on said mechanical system, said first oscillatory input force waveform having a first frequency and a first input force amplitude, said first oscillatory input force waveform causing said mechanical system to vibrate in accordance with a first oscillatory response waveform within a primary mode of resonance in the mechanical system; wherein said controller is further operative to cause said sensor to sense the signals required for said controller to determine a first phase angle between said first oscillatory input force waveform and said first oscillatory response waveform; wherein said controller is further operative to cause said actuator to impose a second oscillatory input force waveform having a second frequency on said mechanical system, said second oscillatory input force waveform causing said mechanical system to vibrate in accordance with a second oscillatory response waveform; wherein said controller is further operative to cause said sensor to sense the signals required for said controller to determine a second phase angle between said second oscillatory input force waveform and said second oscillatory response waveform; wherein said controller is further operative to calculate an undamped natural frequency, a damping ratio and operating points for said mechanical system; wherein said controller is further operative to cause said actuator to vibrate said mechanical system at one of said operating points; wherein said controller is further operative to cause said actuator to increase said input force amplitude until said desired operating condition is reached. In another embodiment, said controller is operative to calculate the amount of energy or power being absorbed by the material to be mixed during operation at the desired operating condition.

In yet another illustrative embodiment, the invention is a method for controlling a system for mixing a plurality of materials, said system being operative to vibrate in an oscillatory motion, said method comprising: detecting a current value of an operating parameter of the system for mixing; detecting a total energy absorbed by said plurality of materials; determining an optimal value for said operating parameter based on said total energy absorbed by the plurality of materials; and changing said current value of said operating parameter to said optimal value. In another embodiment, said operating parameter is a displacement amplitude of the oscillatory motion of the system for mixing and said optimal value is the maximum displacement amplitude of the oscillatory motion of the system for mixing. In another embodiment, the operating parameter is a velocity amplitude of the oscillatory motion of the system for mixing and said optimal value is a maximum velocity amplitude of the oscillatory motion of the system for mixing. In another embodiment, the operating parameter is an acceleration amplitude of the oscillatory motion of the system for mixing and said optimal value is a maximum acceleration amplitude of the oscillatory motion of the system for mixing. In another embodiment, the operating parameter is a jerk amplitude of the oscillatory motion of the mixing system and said optimal value is the maximum jerk amplitude of the oscillatory motion of the mixing system.

In another illustrative embodiment, the invention is a method of controlling a mixing process in an oscillatory device with an electrical control system, said method comprising: monitoring the motion of the oscillatory device; monitoring a power input to the oscillatory device; monitoring a response of the oscillatory device to an input force frequency; calculating an undamped natural frequency and a damping ratio of the oscillatory device; devising an error signal based on said calculation and a set of predetermined parameters; and transmitting said error signal to the electrical control system.

In yet another illustrative embodiment, the invention is a control system for an oscillatory mixing system comprising: a controller that is operative to utilize one or more measured mixing system response parameters to control one or more driving parameters of the oscillatory mixing system calculating an undamped natural frequency and a damping ratio of said oscillatory mixing system and using said undamped natural frequency and said damping ratio to determine one or more optimum driving parameter values under which to operate the oscillatory mixing system to achieve a predefined operating state; and wherein said controller is operative to modify said one or more driving parameters of the oscillatory mixing system to achieve a predefined amount of mixing.

In a further illustrative embodiment, the invention is an oscillatory mixing system comprising: a mechanical system that is configured to contain a material to be mixed; an input force actuator that is configured to impose an oscillatory input force on said mechanical system; a sensor that is configured to sense the motion of said mechanical system; and a controller that is operative to utilize at least one measured mixing system response parameter to control one or more driving parameters of the oscillatory mixing system by calculating an undamped natural frequency and a damping ratio of said mechanical system and using said undamped natural frequency and said damping ratio to determine at least one optimum driving parameter value at which to operate the oscillatory mixing system to achieve a predefined operating state; and wherein said controller is operative to modify said at least one driving parameter of the oscillatory mixing system so that it is equal to said at least one optimum driving parameter value. In another embodiment, said at least one measured mixing system response parameter is selected from the group consisting of: a cumulative power utilized during mixing, an energy efficiency of mixing, a power factor during mixing, a sound pressure of mixing, a sound intensity of mixing, a phase difference between an input force waveform and a measured value related to a response waveform of the oscillatory mixing system, and a measured value related to a response of the oscillatory mixing system. In another embodiment said at least one driving parameter of the oscillatory mixing system is selected from the group consisting of: a frequency of an input force waveform, an amplitude of an input force waveform, a torque driving a plurality of eccentrics, an input voltage to a driver, an input current to said driver, and an elastic coupling rate of compliant means between a plurality of masses. In another embodiment, said predefined operating state is selected from the group consisting of: a maximum energy efficiency, a maximum mixing rate or another specific mixing rate, a maximum acceleration amplitude or another specific acceleration amplitude, a maximum velocity amplitude or another specific velocity amplitude, a maximum displacement amplitude or another specific displacement amplitude, and a maximum jerk amplitude or another specific jerk amplitude. In another embodiment said at least one measured mixing system response parameter is selected from the group consisting of: an acceleration response, a velocity response, a displacement response, and a jerk response; and wherein said one or more measured mixing system response parameters is or are measured at any location on the oscillatory mixing system having a first response that is directly related to a second response at an input force location. In another embodiment, said input force actuator comprises at least one of the following: a hydraulic piston, a hydraulic rotary motor that is operative to drive counter rotating eccentrics, a pneumatic piston, a pneumatic rotary motor that is operative to drive counter rotating eccentrics, an electric rotary motor that is operative to drive counter rotating eccentrics, an electric linear motor, a linear servo motor, a voice coil, and a piezoelectric actuator. In another embodiment, said controller is operative to modify an input force amplitude. In another embodiment said mechanical system further comprises a plurality of masses between which a compliant means is disposed and said controller is operative to vary an elastic coupling rate of said compliant means. In another embodiment said compliant means is selected from the group consisting of: a grommet, a torsional spring, a coil spring, a leaf spring, a disc spring, an elliptical spring, a helical spring, an air spring, a permanent magnet spring, an electromagnet spring, and a cantilever spring. In another embodiment, said mechanical system further comprises a plurality of masses between which a compliant means is disposed and said controller is operative to cause a means for adjusting to adjust an elastic coupling rate of said compliant means. In another embodiment, said means for adjusting is operative to adjust at least one of the following: an air pressure, an electric field, a magnetic field, and a pre-compression of a plurality of springs.

In another embodiment, the invention is a control system for a plurality of oscillatory mixers in a mixing system, said control system comprising: a controller that is operative to determine an undamped natural frequency and a damping ratio of said each of the plurality of oscillatory mixers and use said undamped natural frequency and said damping ratio to modify at least one of an input force amplitude of an input force waveform and an input force frequency of an input force waveform to ensure that a desired operating condition of each of the plurality of oscillatory mixers occurs during mixing. In another embodiment, said controller is operative to independently modify each input force amplitude of said input force waveform and/or each input force frequency of said input force waveform imposed on each oscillatory mixer. In another embodiment, said controller is operative to cause said input force frequency of said input force waveform to be the same for all of said plurality of oscillatory mixers. In another embodiment, said controller is operative to cause the phase of said input force waveform imposed on each of the oscillatory mixers to be in phase or 180 degrees out of phase, thereby using destructive interference to minimize the sound projected from the mixing system. In another embodiment, each oscillatory mixer comprises a resonator having a driver and wherein said desired operating condition comprises: an equal drive current being transmitted to each resonator; an equal power being transmitted to each resonator; a minimum power for the mixing system; a minimum apparent sound generated; or a constant voltage being imposed on each driver. In another embodiment, each of the oscillatory mixers comprises a resonator; wherein said controller is operative to utilize a measured resonator response parameter for each resonator to control a resonator driving parameter for each resonator by determining an optimum resonator driving parameter value for each resonator to achieve a predefined operating state for each resonator; and wherein the controller is operative to modify each said resonator driving parameter for each resonator so that it is equal to said optimum resonator driving parameter value. In another embodiment, each said measured resonator response parameter comprises at least one of the following: a power utilized, a power efficiency, a power factor, a sound pressure, a sound intensity, a phase difference between an input force waveform and a measured value related to said measured resonator response parameter for each resonator. In another embodiment, each said resonator comprises a plurality of eccentrics, a driver or a plurality of masses having a compliant means disposed there between; and wherein each said resonator driving parameter comprises at least one of the following: a frequency of said input force waveform, an amplitude of said input force waveform, a torque driving each of said plurality of eccentrics, an input voltage to each said driver, an input current to each said driver and an elastic coupling rate of each said compliant means. In another embodiment, each said desired operating state comprises at least one of the following: a maximum energy efficient operating condition, a maximum mixing rate or another specific mixing rate, a maximum acceleration amplitude or another specific acceleration amplitude, a maximum velocity amplitude or another specific velocity amplitude, a maximum displacement amplitude or another specific displacement amplitude, and a maximum jerk amplitude or another specific jerk amplitude. In another embodiment, said measured value related to said measured resonator response parameter for each resonator comprises at least one of the following: an acceleration response, a velocity response, a displacement response, and a jerk response; and wherein each measured value related to said measured resonator response parameter for each resonator is measured at any location on each resonator having a motion that is directly related to a response at an input force location. In another embodiment, each resonator comprises: means for applying an input force comprising at least one of the following: a hydraulic piston, a hydraulic rotary motor that is operative to drive counter rotating eccentrics, a pneumatic piston, a pneumatic rotary motor that is operative to drive counter rotating eccentrics, an electric rotary motor that is operative to drive counter rotating eccentrics, an electric linear motor, a linear servo motor, a voice coil, and a piezoelectric actuator. In another embodiment, each resonator comprises: means for adjusting at least one of the following: a hydraulic pressure, a hydraulic flow rate, an electric voltage, an electric current, a pneumatic pressure and a pneumatic flow rate. In another embodiment, each resonator comprises: means for adjusting an elastic coupling rate of a compliant means that is disposed between a plurality of masses, said compliant means being selected from the group consisting of: a grommet, a torsional spring, a coil spring, a leaf spring, a disc spring, an elliptical spring, a helical spring, and air spring, a permanent magnet spring, an electromagnet spring and a cantilever spring. In another embodiment, each resonator comprises a plurality of masses with a compliant means disposed there between and control of each said resonator driving parameter comprises: adjusting an elastic coupling rate of said compliant means. In another embodiment, each resonator further comprises: means for adjusting at least one of the following: an air pressure, an electric field, a magnetic field and a pre-compression of a plurality of springs.

In a further illustrative embodiment, the invention is a method for controlling an oscillatory mixer, said oscillatory mixer being subjected to an oscillatory input force waveform at an input force location and vibrating in accordance with an oscillatory response waveform, said method comprising: driving the oscillatory mixer; measuring a response of the oscillatory mixer; calculating an undamped natural frequency and a damping ratio of said oscillatory mixer based on said response; and controlling the oscillatory mixer using said undamped natural frequency and said damping ratio; wherein said measuring a response step comprises measuring at least a phase angle between the oscillatory input force waveform and the oscillatory response waveform. In another embodiment, controlling the oscillatory mixer comprises adjusting the input force waveform to produce a desired operating condition. In another embodiment, the oscillatory response waveform is characterized by measuring an acceleration, a velocity, a displacement or a jerk at a measurement location on said oscillatory mixer that characterizes said response at said input force location.

In another illustrative embodiment, the invention is a method for controlling a resonant acoustic mixer having mixer contents, said method comprising: accepting from an operator an input of a desired operating condition; controlling the resonant acoustic mixer to operate at a first operational frequency value that is within the range of a primary mode of resonance; measuring a first phase difference between an input force waveform and a resultant displacement response waveform, a velocity response waveform, an acceleration response waveform or a jerk response waveform of a payload mass; controlling the resonant acoustic mixer to operate at a second operational frequency value and measuring a second phase difference; using the two phase difference measurements and the operational frequency values to calculate an undamped natural frequency of the resonant acoustic mixer and a damping ratio; determining a maximum displacement operating point, a maximum velocity operation point, a maximum acceleration operating point or a maximum jerk operating point; and adjusting the operational frequency of the resonant acoustic mixer to cause it to operate at said maximum displacement operating point, said maximum velocity operation point, said maximum acceleration operating point or said maximum jerk operating point. In another embodiment, the user input is in the form of manual control or a preset recipe and a machine operating condition for peak efficiency, or maximum displacement amplitude. In another embodiment, said primary mode of resonance has a primary mode frequency within the range of 58 Hertz to 70 Hertz. In another embodiment, the method further comprises: performing periodic tests to ensure that the resonant acoustic mixer is operating at said maximum displacement operating point, said maximum velocity operation point, said maximum acceleration operating point or said maximum jerk operating point. In another embodiment, the method further comprises: constantly or intermittently calculating the amount of energy and power being absorbed by the mixture being mixed in the resonant acoustic mixer. In another embodiment, mixing continues until a desired amount of energy is absorbed into the mixture, until the operator terminates the mixing process, or until one or more salient mixing attributes is reached. In another embodiment, the salient mixing attributes include a maximum temperature, a pressure, a viscosity, a color, a tackiness, a quality, a homogeneity and/or a separation. In another embodiment, the method further comprises: executing a supervisory protection algorithm that ensures that the resonant acoustic mixer continues to operate under safe operating conditions even if the mixture contents decouples from the resonant acoustic mixer.

In another illustrative embodiment, the invention is a method for controlling a resonant mixer, said resonant mixer comprising an actuator and a mixing vessel or platform, said method comprising: operating the actuator at a first oscillatory input force waveform having a first frequency and a first input force amplitude to produce a first associated oscillatory response waveform; measuring a first phase angle between said first oscillatory input force waveform and said first associated oscillatory response waveform; controlling the actuator at a second oscillatory input force waveform having a second frequency to produce a second associated oscillatory response waveform; determining a second phase angle between said second oscillatory input force waveform and said second associated oscillatory response waveform; calculating an undamped natural frequency and a damping ratio; using the undamped natural frequency to determine a phase angle set point; using a look-up table to determine a third oscillatory input force waveform having a third frequency, based on said phase angle set point; and imposing said third oscillatory input force waveform having a third frequency on said mixing vessel or platform.

In another illustrative embodiment, the invention is a method for controlling a plurality of resonant mixers, each resonant mixer comprising a an actuator and a mixing platform, said method comprising: imposing a first input force frequency on each of the resonant mixers and recording said first input force frequency and a first amount of electrical current being drawn by each of the actuators; imposing a second input force frequency on each of the resonant mixers and recording said second input force frequency and a second amount of electrical current being drawn by each of the actuators, said second input force frequency being higher than said first input force frequency; for each said resonant mixer, determining a difference between said second amount and said first amount; if said difference is positive for all of said actuators or if said difference is negative for one of said actuators that is drawing the least amount of current and positive for another of said actuators that is drawing the most amount of current, imposing a third input force frequency on each of the resonant mixers that is higher than said second input force frequency; and if said difference is negative for all of said actuators or if said difference is positive for one of said actuators that is drawing the least amount of current and negative for another of said actuators that is drawing the highest amount of current, imposing a third input force frequency on each of the resonant mixers that is larger than said second input frequency of vibration.

In yet another illustrative embodiment, the invention is a method for controlling a resonant mixer, said resonant mixer comprising an actuator and a mixing vessel or platform, said method comprising: establishing a first phase angle setpoint and a first pre-set amount; operating the actuator at a first oscillatory input force waveform having a first frequency and a first input force amplitude to produce a first associated oscillatory response waveform in said a mixing vessel or platform; measuring a first phase angle between said first oscillatory input force waveform and said first associated oscillatory response waveform; if said first phase angle is within said first pre-set amount of said first phase angle setpoint, continuing to operate the actuator at said first oscillatory input force waveform having said first frequency and said first input force amplitude to produce said first associated oscillatory response waveform; if said first phase angle is not within said first pre-set amount, operating the actuator at a second oscillatory input force waveform having a second frequency to produce a second associated oscillatory response waveform; determining a second phase angle between said second oscillatory input force waveform and said second associated oscillatory response waveform; calculating an undamped natural frequency and a damping ratio; using said undamped natural frequency and said damping ratio to determine a third oscillatory input force waveform having a third frequency; and operating said actuator at said third oscillatory input force waveform having said third frequency.

In another preferred embodiment, the invention is a system for controlling a resonant mixer, said resonant mixer comprising an actuator and a mixing vessel or platform, said system comprising: means for operating the actuator at a first oscillatory input force waveform having a first frequency and a first input force amplitude to produce a first associated oscillatory response waveform; means for measuring a first phase angle between said first oscillatory input force waveform and said first associated oscillatory response waveform; means for controlling the actuator at a second oscillatory input force waveform having a second frequency to produce a second associated oscillatory response waveform; means for determining a second phase angle between said second oscillatory input force waveform and said second associated oscillatory response waveform; means for calculating an undamped natural frequency and a damping ratio; means for using the undamped natural frequency to determine a phase angle set point; means for using a look-up table to determine a third oscillatory input force waveform having a third frequency, based on said phase angle set point; and means for imposing said third oscillatory input force waveform having a third frequency on said mixing vessel or platform.

In another illustrative embodiment, the invention is a system for controlling a plurality of resonant mixers, each resonant mixer comprising an actuator and a mixing platform, said system comprising: means for imposing a first input force frequency on each of the resonant mixers and recording said first input force frequency and a first amount of electrical current being drawn by each of the actuators; means for imposing a second input force frequency on each of the resonant mixers and recording said second input force frequency and a second amount of electrical current being drawn by each of the actuators, said second input force frequency being higher than said first input force frequency; means for determining a difference between said second amount and said first amount for each said resonant mixer; means for imposing a third input force frequency on each of the resonant mixers that is higher than said second input force frequency if said difference is positive for all of said actuators or if said difference is negative for one of said actuators that is drawing the least amount of current and positive for another of said actuators that is drawing the most amount of current; and means for imposing a third input force frequency on each of the resonant mixers that is larger than said second input frequency of vibration if said difference is negative for all of said actuators or if said difference is positive for one of said actuators that is drawing the least amount of current and negative for another of said actuators that is drawing the highest amount of current, imposing a third input force frequency on each of the resonant mixers that is larger than said second input frequency.

In another illustrative embodiment, the invention is a system for controlling a resonant mixer, said resonant mixer comprising an actuator and a mixing vessel or platform, said system comprising: means for establishing a first phase angle setpoint and a first pre-set amount; means for operating the actuator at a first oscillatory input force waveform having a first frequency and a first input force amplitude to produce a first associated oscillatory response waveform in said mixing vessel or platform; means for measuring a first phase angle between said first oscillatory input force waveform and said first associated oscillatory response waveform; means for continuing to operate the actuator at said first oscillatory input force waveform having said first frequency and said first input force amplitude to produce said first associated oscillatory response waveform if said first phase angle is within said first pre-set amount of said first phase angle setpoint; means for operating the actuator at a second oscillatory input force waveform having a second frequency to produce a second associated oscillatory response waveform if said first phase angle is not within said first pre-set amount; means for determining a second phase angle between said second oscillatory input force waveform and said second associated oscillatory response waveform; means for calculating an undamped natural frequency and a damping ratio; means for using said undamped natural frequency and said damping ratio to determine a third oscillatory input force waveform having a third frequency; and means for operating said actuator at said third oscillatory input force waveform having said third frequency.

In a further illustrative embodiment, the invention is an oscillatory mixing system comprising: a mechanical system that is configured to contain a material to be mixed; an input force actuator that is configured to impose an oscillatory input force on two moving masses in said mechanical system; a sensor that is configured to sense the motion of said mechanical system; and a controller that is operative to utilize at least one measured mixing system response parameter to control one or more driving parameters of the oscillatory mixing system Further aspects of the invention will become apparent from consideration of the drawings and the ensuing description of exemplary embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate exemplary embodiments of the invention. In the drawings:

FIG. 11 is a table that shows the relationships between maximum displacement amplitude, maximum velocity amplitude and maximum acceleration amplitude operating frequencies with respect to the undamped natural frequency and the damping ratio of a vibratory/oscillating mixer in accordance with an illustrative embodiment of the invention.

Figure 1:
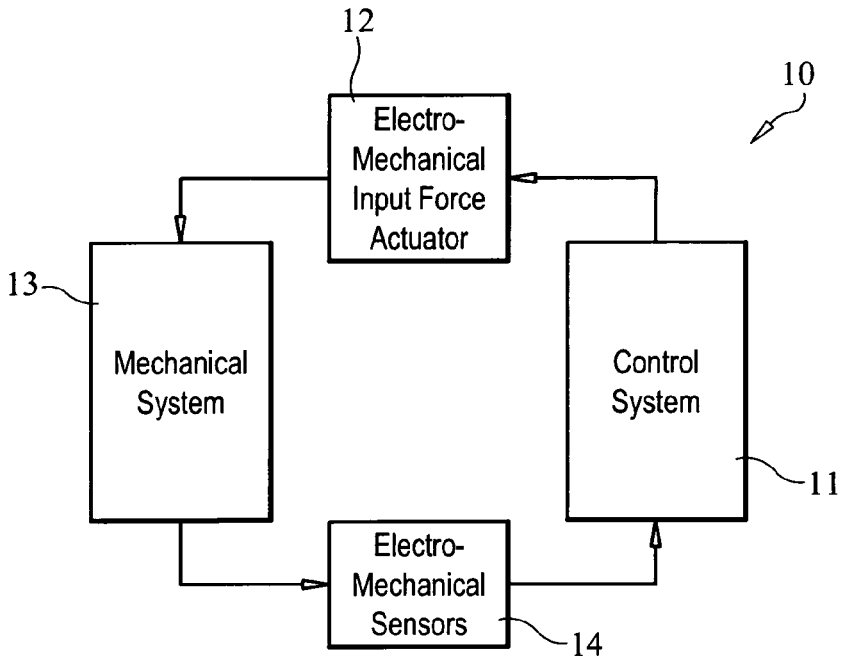
FIG. 1 is a schematic block diagram of an illustrative embodiment of the invention.

The following reference numerals are used to indicate on the drawings the parts and environment of an illustrative embodiment of the invention:

10 vibratory/oscillatory system
11 control system
12 electro-mechanical input force actuator
13 mechanical system
14 electro-mechanical sensors
20 accept operator input step
22 initiate control step
24 measure first phase angle step
26 measure second phase angle step
28 calculate natural frequency step
30 adjust frequency step
32 recalculate operating point step
34 confirm operating condition step
36 increase input force amplitude step
38 perform periodic tests step
40 calculate energy and power step
42 terminate mixing step
44 execute supervisory protective algorithm step
50 first resonator
52 second resonator
122 load material step
124 input settings step
126 start step
128 enable supervisory control loop step
130 empty container check step
132 empty mixing container detected step
134 stop machine step
136 mixing complete step
138 remove mixing contents
140 supervisory control loop stop requested step
142 execute acceleration control loop step
144 execute frequency control loop step
146 check g-loop timer step
148 g-loop step
150 check phase loop timer step
152 calculate phase angle setpoint step
154 calculate frequency step
156 phase loop step
160 adjust frequency and current step
162 determine change in current step
164 check for current increase step
166 check for current decrease step
170 adjust frequency in opposite direction step
172 adjust frequency in same direction step
174 first current check step
176 second current check step
190 check phase angle step
192 adjust input force operating frequency
200 linear drive motor
201 magnet
202 bobbin
203 frame
204 reaction mass
205 payload mass
206 mix vessel
207 springs
208 ground, mounting surface

DETAILED DESCRIPTION OF THE INVENTION

In illustrative embodiments, the present invention is a device and method for controlling a mixing system at an optimal efficiency point based on a displacement operating point, a velocity operating point, an acceleration operating point or a jerk operating point. In mixing applications, depending on the type of material being mixed, it may be optimal to operate the machine on the highest (maximum) displacement, velocity, acceleration or jerk available with the machine.

However, it may also be advantageous to operate the mixing system at a condition in which any or all of these parameters are not at a maximum. For example, a maximum condition of one of the above may cause adverse effects on the materials being mixed, damaging them, or causing them to over-mix, segregate, preclude bulk mixing, etc., as well as decouple from the mixing container. As such, the velocity amplitude, acceleration amplitude or jerk amplitude of the mixer may be adjusted to a non-maximum operating condition in order to obtain a desired processing condition.

When optimal mixing is accomplished with an oscillatory/vibratory mixer, the contents of the mixer (the material being mixed) are coupled with the mechanical machine and are absorbing energy (damping the system). The amount of energy being absorbed over time can change during the mixing process. Thus, a smart method of determining the most energy efficient operating state, maximum displacement amplitude, maximum velocity amplitude, maximum acceleration amplitude, or maximum jerk amplitude of the vibratory mixing vessel is desirable. Dynamics of the energy absorbed by the mixing phenomena determine optimal operating conditions. Optimal operating conditions are not always at a predetermined phase angle or phase relationship between the input force waveform and the system response waveform.

Referring to FIG. 1, a schematic block diagram of vibratory/oscillatory system 10 is presented. In this embodiment, vibratory/oscillatory system 10 comprises control system 11, electro-mechanical input force actuator 12, mechanical system 13 and electro-mechanical sensors 14. Control system 11 includes circuitry that is capable of accepting a sensor signal from electro-mechanical sensors 14, interpreting the sensor signal in relation to desired operational parameters and constructing an error signal in response to the sensor signal and the desired operational parameters. Control system 11 then creates an input signal that is used to drive the electro-mechanical input force actuator 12. Electro-mechanical input force actuator 12 converts electrical energy into mechanical energy to drive mechanical system 13. The response of mechanical system 13 is sensed (and in some embodiments recorded) by electro-mechanical sensors 14.

In this embodiment, electro-mechanical sensors 14 include a motion sensor for sensing the response of mechanical system 13 to input forces. Electro-mechanical sensors 14 monitor and detect motion, power input and response to frequency. Electro-mechanical sensors 14 then send a signal to control system 11. The electro-mechanical input force may be generated by a linear electrical linear actuator, rotary motors spinning eccentric weights and/or piezoelectric actuators. In an alternative embodiment, the input force is generated by hydraulic means or another mechanical system. In the hydraulic input force embodiment, control system 11 controls hydraulic control valves.

Figure 2:
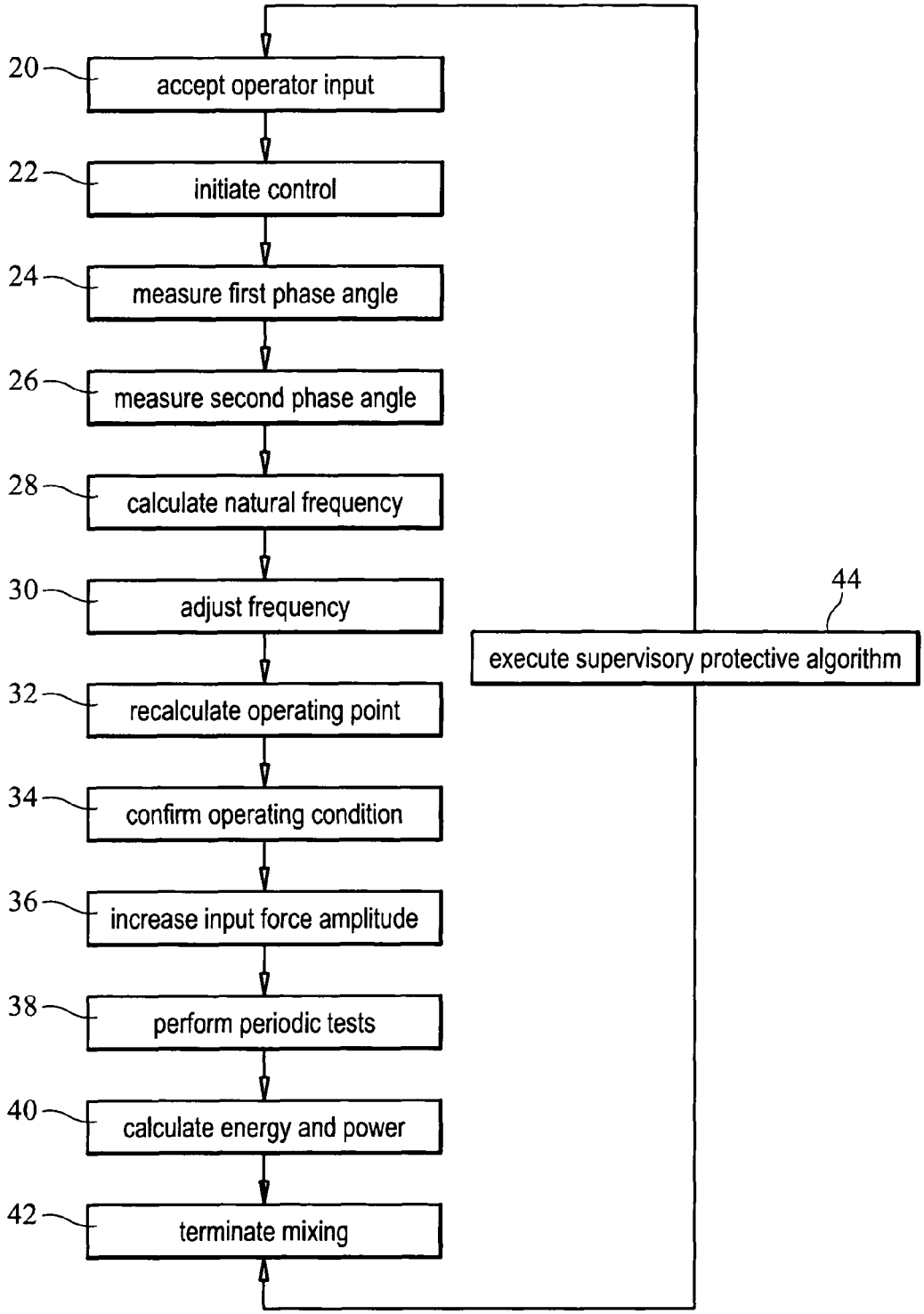
FIG. 2 is a schematic process flow diagram of another illustrative embodiment of the invention.

Referring to FIG. 2, an illustrative embodiment of a process for operating vibratory/oscillatory system 10 is presented. In this embodiment, the operator inputs to control system 13 desired operating conditions for vibratory/oscillatory system 10 in accept operator input step 20. The input is preferably in the form of a single desired operating condition or endpoint or a preset recipe of desired operating conditions which may include one or more machine operating conditions for peak efficiency, maximum displacement amplitude, maximum velocity amplitude, maximum acceleration amplitude and/or maximum jerk amplitude. In initiate control step 22, control system 11 then starts and controls mechanical system 13 (e.g., a resonant acoustic mixer) at a vibratory/oscillatory frequency that is within the range of the primary mode of resonance of mechanical system 13. Typically, for resonant mixers, the frequency of the primary mode of resonance lies within the range of 58 Hz to 70 Hz.

In measure first phase angle step 24, control system 13, an initial phase angle measurement is taken and recorded between the phase of the input force waveform and phase of the resultant displacement response waveform, velocity response waveform, acceleration response waveform or jerk response waveform of mechanical system 13 (e.g., a payload mass) sensed by electro-mechanical sensors 14. In measure second phase angle step 26, control system 11 then adjusts the frequency and takes and records a second phase angle measurement. The amount of each frequency adjustment depends on the response of mechanical system 13, but the frequency is adjusted in the direction that causes the phase angle to change toward 90 degrees until an adequate amount of phase change has occurred to ensure good signal to noise ratio, which is typically 0.25 Hz.

In calculate natural frequency step 28, control system 11 uses the two phase angle values and the associated frequency values to calculate the undamped natural frequency and the damping ratio of mechanical system 13. Control system 11 also calculates operating points for maximum displacement, maximum velocity, maximum acceleration or maximum jerk using the relations displayed in FIG. 11.

Control system 11 then adjusts the operating frequency of mechanical system 13 to the calculated operating point in adjust frequency step 30. In recalculate operating point step 32, control system 11 then repeats steps 24 through 28 until it confirms that mechanical system 13 is operating at the desired operating frequency in confirm operating condition step 34. This step is needed because, under different operating conditions, the resonant frequency of mechanical system 13 changes, as is displayed in FIG. 3, and thus dynamic control is needed.

Once the desired operating frequency is reached, control system 11 increases the amplitude of the input force until the desired operating condition(s) are reached in increase input force amplitude step 36. Periodic tests are performed in perform periodic tests step 38 to ensure that mechanical system 13 is operating at the desired frequency and, if control system 11 finds that the frequency is not what it predicts, then control system 11 repeats steps 24 through 36.

In calculate energy and power step 40, during operation at the desired operating conditions, the control system 11 constantly or intermittently calculates the amount of energy and/or power being absorbed by the mixing process. The mixing process continues until a desired amount of energy is absorbed by the mixture, until the operator terminates the mixing process or until one or more other salient mixing attributes are reached such as maximum temperature, pressure, viscosity, color, tackiness, quality, homogeneity, separation, etc. At this point, mixing is terminated in terminate mixing step 42. In preferred embodiments, during all the above steps, a supervisory protection algorithm is executed in execute supervisory algorithm step 44 that ensures that mechanical system 13 (e.g., resonant acoustic mixer) continues to operate under safe operating conditions even if the mix contents decouple from the mixer.

Figure 4:
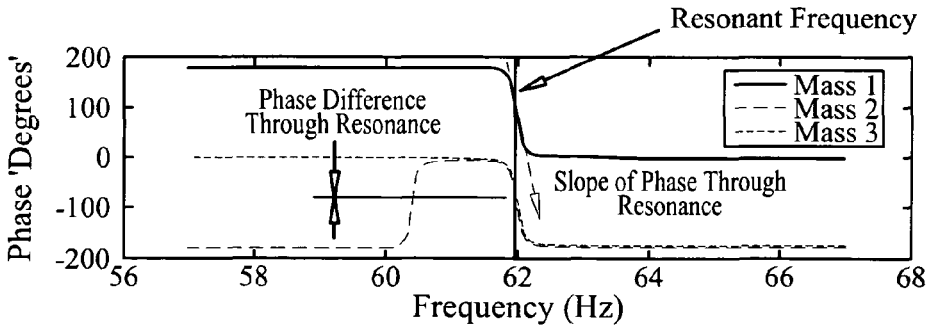
FIG. 4 is a phase diagram of signals from an illustrative three-mass embodiment of the invention with a damping constant of 40 Newton seconds per meter (N*s/m).
Figure 5:
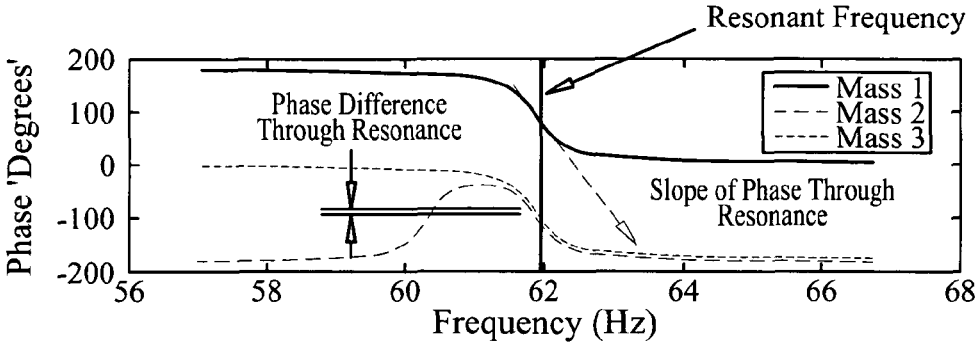
FIG. 5 is a phase diagram of signals from an illustrative three-mass embodiment of the invention with a damping constant of 400 N*s/m.
Figure 6:
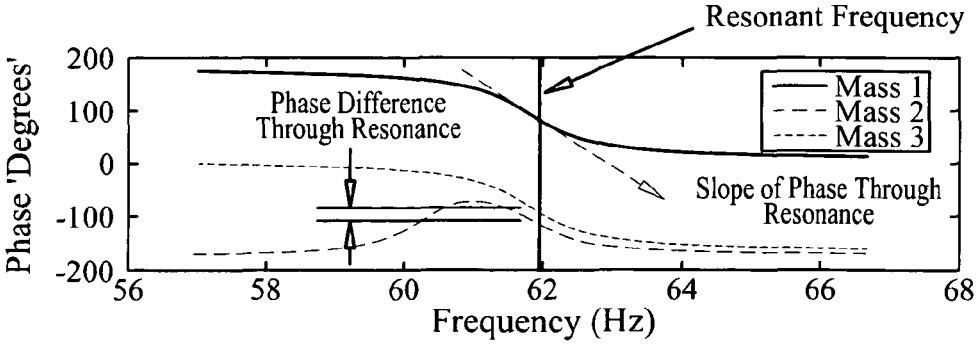
FIG. 6 is a phase diagram of signals from an illustrative three-mass embodiment of the invention with a damping constant of 1000 N*s/m.
Figure 7:
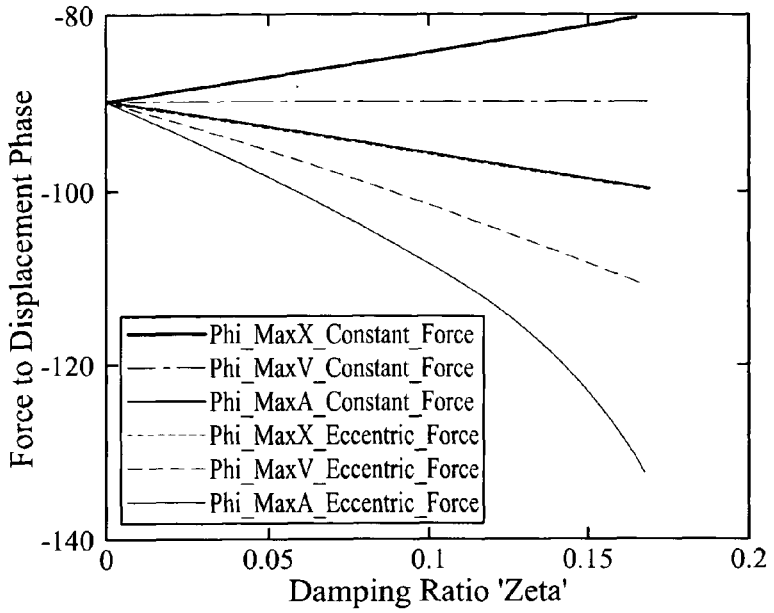
FIG. 7 is a diagram illustrating the resultant phase for the maximum amplitudes of displacement, velocity and acceleration for an illustrative embodiment of a constant force and eccentric driven one mass, mechanical mass/spring/damper system. The indicated phase is the phase angle between the input force waveform and the resultant displacement waveform.
Figure 8:
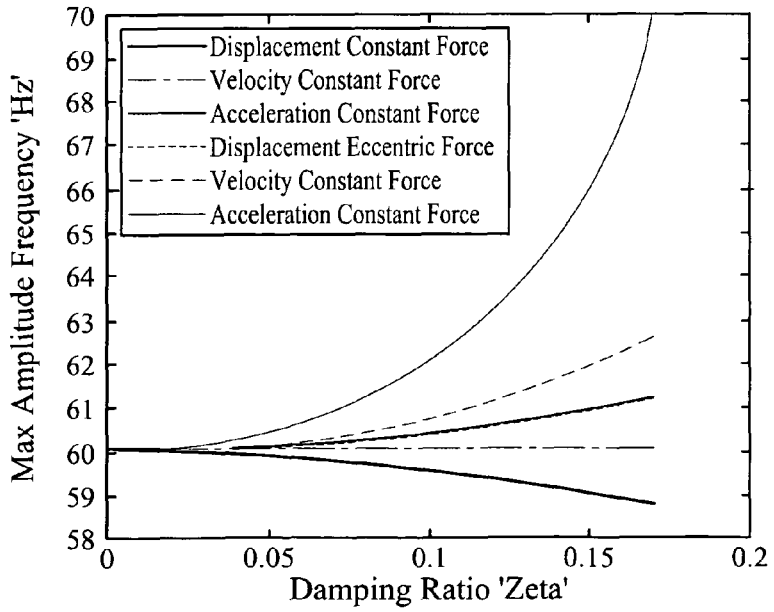
FIG. 8 is a diagram illustrating frequencies at which the maximum displacement amplitude, velocity amplitude, and acceleration amplitude occur as a function of damping ratio for illustrative embodiments of both constant force and eccentric driven systems.

When a mechanical oscillatory system is used to mix materials, the amount of energy being absorbed by the mixing process can be modeled and treated as damping of the mechanical oscillatory system. Referring to FIGS. 4, 5, 6, 7 and 8, plots of the responses of a modeled mechanical oscillatory system to changes in damping constant are presented. FIGS. 4, 5 and 6 are phase diagrams for a three mass mechanical system with damping constants of 40 Newton-seconds/meter (N*s/m), 400 N*s/m and 1000 N*s/m respectively. In this case, the modeled system is a three-mass system of the type disclosed in U.S. Pat. No. 7,188,993, the disclosure of which patent is incorporated herein by reference as if fully set forth herein.

Examination of FIGS. 4, 5, 6, 7 and 8 shows that varying the damping value changes the response of the mechanical oscillatory system to an input force. The damping constant or value is a lumped term that represents the amount of linear damping the material being mixed is imposing on the mechanical oscillatory system.

FIGS. 4, 5 and 6 illustrate that the slope of the phase angle through resonance can directly indicate the amount of damping of the system. These figures show that at higher damping values the slopes of the phase through resonance are considerably different. Also, this figures show that the slopes and phase angles at frequencies close to the undamped natural frequency are very different. Thus, this approach is not a preferred method or a very direct method for finding the amount of damping of the system. There exists a relationship between phase angle and system damping at each phase angle increment, but the maximum sensitivity (phase angle slope) is obtained at a phase angle of 90 degrees. Because the phase angle plot has the most sensitivity at a phase angle of 90 degrees and it is close to the desired operating condition, it is an appropriate reference value at which to take damping measurements. Thus, this is another approach to calculating the amount of damping in accordance with step 40. Neither method step has to be performed at the ninety degree point or at the desired operating conditions, but this approach works better when used at the ninety degree point. However, these are not the only methods for finding the amount of damping, and a more direct method is described below.

Figure 3:
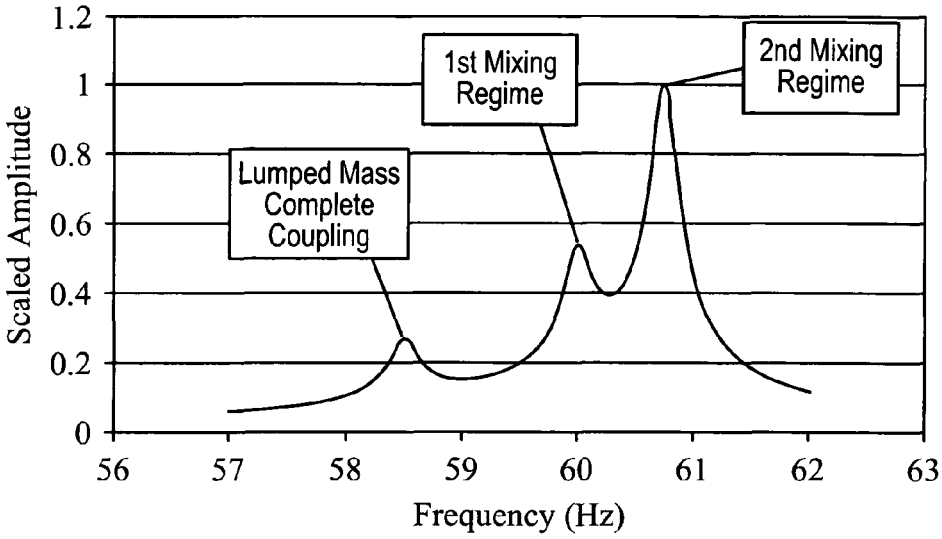
FIG. 3 is a diagram presenting a plot of typical acceleration amplitudes for a frequency sweep of a mechanical system mixing water in a standard cylindrical vessel with approximately 50 percent air in accordance with an illustrative embodiment of the invention.

The system response as shown in FIG. 3 can vary substantially when mixing different types of materials. For example, for mixing solid-solid materials such as dry powders, there typically only exists one transition peak showing two peaks in a frequency sweep. The amount of damping can decrease, increase or stay constant with increased displacement oscillation of the mixing vessel.

In FIG. 3, there are three peaks. The first peak shows the excitation (system response) when the material being mixed is directly coupled to the mixing vessel and all the mass is moving along with the vessel (no difference in velocity profiles between the vessel and the mass). As acceleration is increased, the material being mixed begins to decouple by having a void or areas filled with a compressible media between it and the vessel wall. Typically, the first mixing regime is characterized by a concentrated large bubble with a few small regions of smaller bubbles. The second mixing regime occurs when the larger bubble no longer exists and there are many small bubbles throughout the mixing vessel. Each of these regimes has less effective mass of material being mixed directly coupled to the mixing vessel at any given time. The effective spring rate between the mixing vessel and the material being mixed also decreases with each regime change. In the lumped mass complete coupling peak, the effective spring rate between the mixing vessel and the material being mixed is very large.

FIG. 3 shows how the response of mechanical system 13 changes during a frequency sweep due to the changes in the damping and spring characteristics of the mixed material when the mass does not change because the mixing vessel is a closed system. A frequency sweep is performed by changing the frequency of the oscillating input force (e.g., speed of rotation of counter rotating eccentrics) fast enough to not excite mechanical system 13 to harmful amplitudes, but also slow enough to allow time for the vibrations of mechanical system 13 to build to adequate amplitudes so that usable data can be recorded. An appropriate speed for the frequency sweep is determined by the amount of damping of the mechanical system 13 and the time constant of the mechanical system 13.

When increasing the input force frequency, the amplitude of the system response has defined zones or peaks. It can be appreciated that increasing the force input to the system has a similar effect. These peaks or zones have defined damping values and affect the response of the overall system. If the frequency is changed too quickly, the system does not have time to respond and the actual system response is masked by sweeping too quickly. Thus, great care needs to be taken to design the frequency sweep speed to ensure an adequate system response. This also applies to changing the frequency and getting adequate system response and phase angle readings. If the damping is very low, the system will take a great deal of time to settle down after a transient change in the system.

Figure 9:
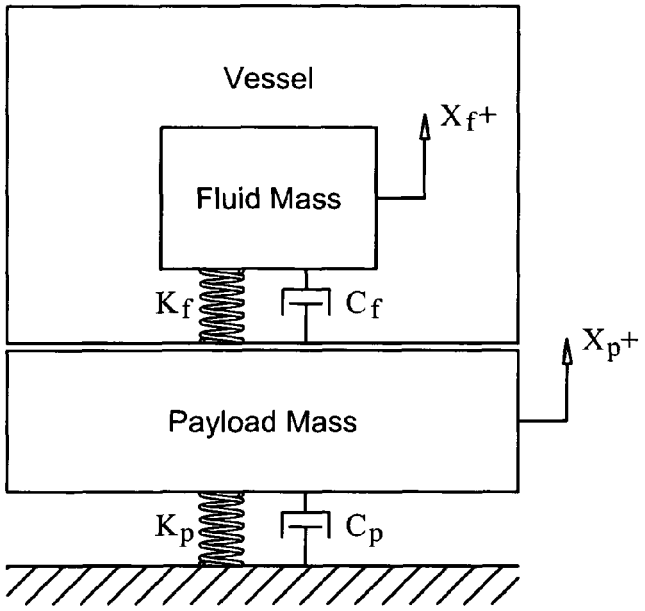
FIG. 9 is a schematic diagram showing that contents being mixed in a mixing vessel can be modeled as a spring/mass/damper system in accordance with an illustrative embodiment of the invention.

In some embodiments, the invention involves controlling mixing so as to cause a desired amount of mechanical power to be absorbed during mixing. The amount of mechanical power absorbed during mixing can be calculated by multiplying the damping constant by the mixing vessel velocity squared, if the mixing system is modeled strictly as a dashpot. Alternatively, the contents being mixed may also be modeled as an equivalent spring/mass/damper, two mass system as shown in FIG. 9. The mechanical power is then calculated by multiplying the damping constant multiplied by the square of the difference in velocities between the mixing vessel and the contents being mixed. The payload mass is the mass of the vessel and any structure needed to support the vessel and react to the input force. The velocity of the fluid mass (material being mixed) is difficult to measure or even to see. However, this lumped model is very useful in predicting the ideal conditions and power that is absorbed for different coupling and degrees of damping of the material being mixed. Thus, by having a model that considers the amount of power absorbed, the ideal coupling and damping conditions may be predicted. When the control system is controlling the mixing process, the degree of coupling and damping may be determined from the system response, which is explained below using FIGS. 7 and 8. In short, there exists a relationship between the system response amplitude and phase under some measurement conditions that may be used to determine the coupling and damping of the system.

Similar frequency sweep plots can be generated for a flow-through mixing system, but, in that case, the effect of a varying equivalent mass is changing because, in an oscillating system, the mass flow rate is varying due to the effective coupling of the mixed material and the vessel. Because of the changing of mass, a flow-through system is more dynamic than a closed system, but can be controlled in the same way, in accordance with methodologies disclosed below that also take into account this varying condition. When the mass flows are tuned to produce a constant mass flow rate, a stable continuous flow-through mixing system is achieved, and then an approach to system control may be used that is the same as described earlier.

Figure 10A:
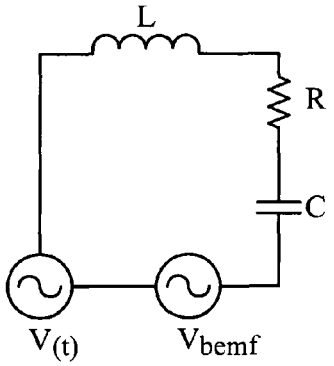
FIGS. 10A and 10B are schematic diagrams for an example electro-mechanical system that is coupled. Operation of the system at mechanical resonance does not mean the electrical system is also at resonance. Thus, the power factor must be corrected in accordance with an illustrative embodiment of the invention.
Figure 10B:
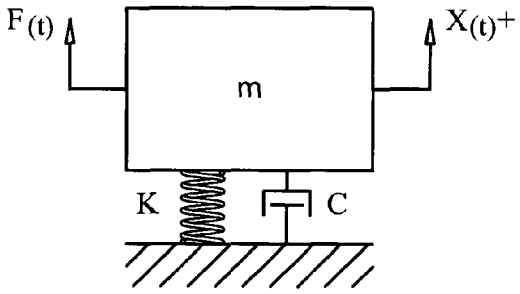

FIGS. 9, 10A and 10B illustrate how a mixing system can also be modeled as a spring/mass/damper system. Overall, system performance is determined by how the two subsystems (the vibratory mechanical system and the material being mixed) couple. FIG. 3 indicates these phenomena in the defined peaks. The first peak is at the lowest frequency at which the two subsystems are completely coupled. Energy transfer is highest at this first peak. As the frequency of oscillation increases, the regimes change and less coupling occurs. Coupling is preferably not complete, as this causes the mix material to move along with the vessel and no mixing occurs. In a fully decoupled system, for example, a thick paste pulls away and bounces in the vessel. Thus, a well coupled system, for example for a thick paste, occurs when bulk mixing is occurring and material to be mixed is flowing from the bottom up the center and down the sides of a vertical cylindrical mixing vessel.

In the illustrative embodiment of the invention illustrated in FIG. 10B, a single mass system is attached to ground by a spring and a damper. The system is driven by an electromechanical actuator, typically a voice coil or linear actuator. Because the amplitude of the input force is typically assumed to be independent of frequency, this type of system is called a constant force system. The single mass system with electrical driving circuit is modeled and displayed in FIGS. 10A and 10B. It is noted that the two systems (electrical system and mechanical system) are coupled through the electromotive force constants, $K_{bemf}$, and $K_f$. These constants relate the current flowing through the actuator to the force acting on the mechanical system and the velocity which acts as a voltage on the electrical system. For a mixing system, the voltage is typically a voltage drop because the mechanical system is performing work (mixing).

Applying a force balance to a constant force, single degree of freedom system yields the governing differential equation of motion, as displayed in FIG. 10B. The displacement amplitude and phase difference (between the input force and the response displacement amplitude) are given by Equations 1 and 2. Note that these relations are readily found in standard background art texts on vibration.

$$X = \frac{F_o}{k_1 \cdot \sqrt{\left[1 - \left(\frac{\omega}{\omega_n}\right)^2\right]^2 + \left(2 \cdot \zeta \cdot \frac{\omega}{\omega_n}\right)^2}} \tag{1}$$

$$\tan(\theta) = \frac{2 \cdot \zeta \cdot \left(\frac{\omega}{\omega_n}\right)}{1 - \left(\frac{\omega}{\omega_n}\right)^2} \tag{2}$$

The applicants discovered that the phase equation can be used to find the damping ratio '$\zeta$' and the undamped natural frequency '$\omega_n$' by taking measurements of the phase and the input forcing frequency. At one input force frequency, a first set of operating conditions of frequency and phase are recorded. Changing the input force frequency allows for a second set of operating conditions of frequency and phase to be recorded. The two sets of data may then be placed into equations 3 and 4 which are used to find the two unknowns: the damping ratio '$\zeta$' and the undamped natural frequency '$\omega_n$':

$$\omega_n^2 = \frac{\omega_2^2 \cdot \omega_1 \cdot \tan(\theta_1) - \omega_1^2 \cdot \omega_2 \cdot \tan(\theta_2)}{\tan(\theta_2) \cdot \omega_1 - \tan(\theta_1) \cdot \omega_2} \tag{3}$$

$$\zeta = \frac{\tan(\theta_1) \cdot (\omega_n^2 - \omega_1^2)}{2 \cdot \omega_1 \cdot \omega_n} = \frac{\tan(\theta_2) \cdot (\omega_n^2 - \omega_2^2)}{2 \cdot \omega_2 \cdot \omega_n} \tag{4}$$

These relations are derived for a single mass/spring/damper system and may also be derived for more complex mechanical, electrical and electro-mechanical systems. Once the damping ratio and undamped natural frequency are found, then a relation between the undamped natural frequency and the chosen operating condition(s) may be used in control of the system. A list of operating relations for an exemplar single mass system is displayed in FIG. 11.

FIG. 11 presents relations that may be used to determine the angular frequencies of the maximum displacement, velocity, and acceleration response amplitude in terms of the undamped natural frequency and the damping ratio of the mechanical system. These relations are derived from a simple one degree of freedom lumped mass model for both a constant force amplitude and eccentric driven systems. These relations may also be derived for more advanced systems and provide a method for finding the desired values in real time without the need for complicated value seeking algorithms. These relations also allow for checking to confirm that operating conditions are correct.

There are typically two types of forced systems: (1) systems in which input force is unaffected by the input forcing frequency, e.g., a voice coil actuator system; and (2) eccentric driven systems in which the input force is based on equation 5 that shows that the input force is equal to the mass of the offset eccentric multiplied by the mass moment center relative to the center rotation axis multiplied by the angular frequency squared:

$$F = m \cdot r \cdot \omega_f^2 \tag{5}$$

By examining the response of a modeled system in terms of displacement, velocity and acceleration, the above derived relations can be visualized.

In operation of an oscillatory system, the maximum displacement, maximum velocity and maximum acceleration are not all reached at the same operating frequency. If a mixing system is more sensitive or requires the most acceleration the system can produce, then the maximum acceleration frequency should be the chosen point of operation. At the point of maximum acceleration, it is noted in FIG. 12 that the displacement has dropped by almost 10 percent from its peak. It is also noted that the acceleration has risen by almost 10 percent as opposed to the same operating condition given the same input force operating at the frequency at which maximum displacement occurs.

Figure 12:
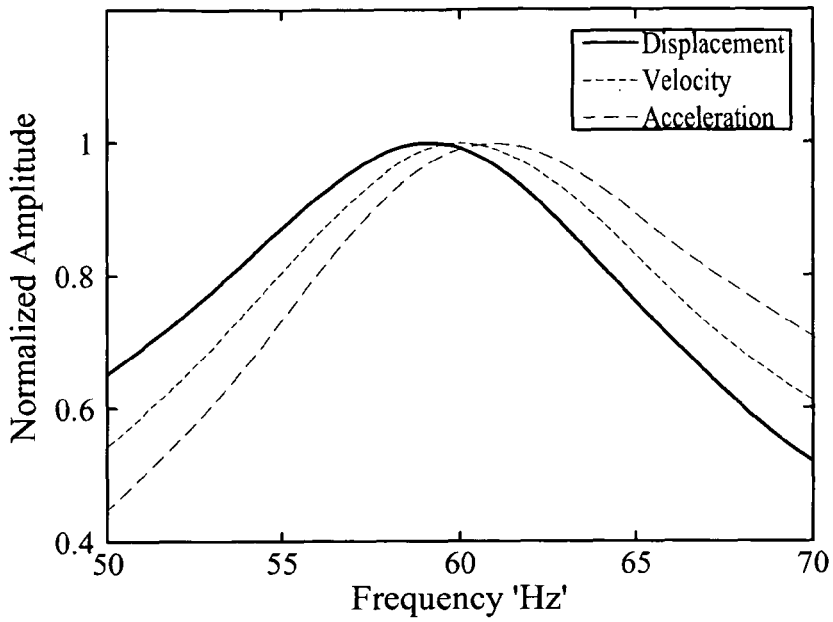
FIG. 12 is a diagram illustrating normalized amplitudes of acceleration, velocity and displacement as a function of input forcing frequency for an illustrative embodiment of a constant force driven system.

Referring again to FIG. 12, the displacement, velocity and acceleration responses of an illustrative single degree of freedom system with a constant amplitude forcing function (a constant force system) is displayed. FIG. 12 demonstrates that the displacement, velocity and acceleration responses of an oscillating mass driven with a constant force input are very different from one other. This plot also shows that when a constant force system is at a point of maximum displacement amplitude, the velocity and the acceleration are not at a maximum. A similar situation occurs at the maximum velocity and maximum acceleration amplitude conditions. In this example, the maximum displacement, maximum velocity and maximum acceleration peaks are at 59.14 Hertz (Hz), 60 Hz, and 60.86 Hz, respectively.

Figure 13:
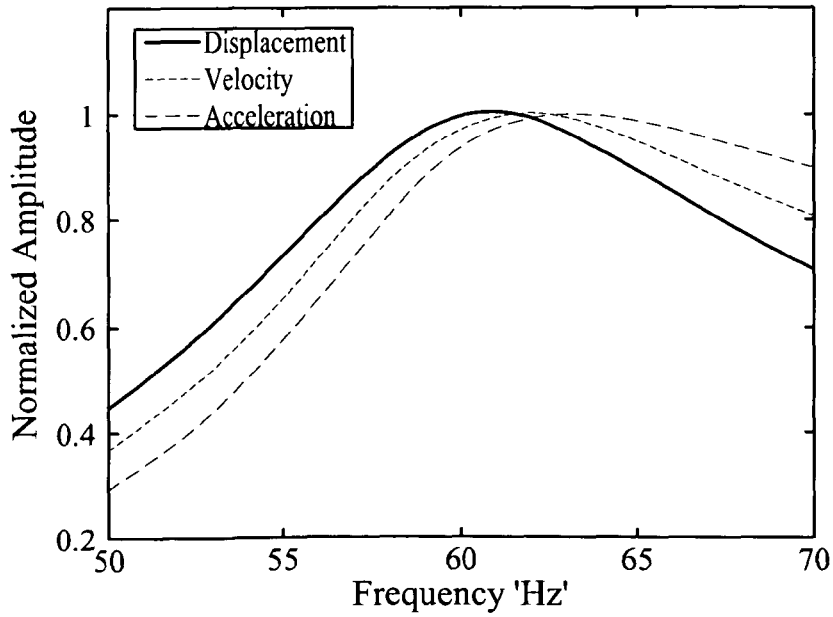
FIG. 13 is a diagram illustrating normalized amplitudes of acceleration, velocity and displacement as a function of input forcing frequency for an illustrative embodiment of an eccentric driven system.

Referring to FIG. 13, the displacement, velocity, and acceleration responses of an illustrative eccentric driven, single degree of freedom system are displayed. FIG. 13 demonstrates that the displacement, velocity, and acceleration response of an oscillating mass driven with an eccentric driven force input are also very different from each other. This plot also shows that when the system is at a point of maximum displacement amplitude, the velocity amplitude and the acceleration amplitude are not at a maximum. It is noted that the frequencies at which the maximum displacement, maximum velocity and maximum acceleration occur are further apart than those of the constant force systems that are subjected to a force having an amplitude that is independent of frequency.

A similar situation occurs at the maximum velocity amplitude and at maximum acceleration amplitude conditions. In this example, the maximum displacement, maximum velocity and maximum acceleration peaks are at 60.86 Hz, 61.84 Hz, and 63.09 Hz, respectively. It is often advantageous to mix at a maximum displacement, maximum velocity, maximum acceleration or maximum jerk as opposed to at peak energy use efficiency, because faster mixing can be achieved, thereby minimizing labor costs, albeit with increased power consumption.

In illustrative embodiments of the invention, there is a phase angle (phase difference) or delay between the phase of the input force waveform and the phase of the resultant system response waveform. For a single mass oscillating system, the operating point of maximum energy efficiency at a zero damping ratio is the point at which the phase angle of the input force waveform is leading by 90 degrees (in front of) the resultant displacement waveform (which is in phase with the resultant velocity waveform). The amount of damping can change a great deal during the mixing process, however, and thus the phase angle may not be at the peak energy efficiency operating point of 90 degrees when the system is operating at the peak displacement, peak velocity, peak acceleration or peak jerk operating points.

Referring again to FIG. 7, the phase angle (the difference between the phase of input force waveform and the phase of the response waveform) at the maximum displacement, maximum velocity and maximum acceleration points for both constant force and eccentric driven single mass systems at varying damping ratios is presented. In this figure, damping is expressed as the damping ratio 'Zeta', which is a normalized scale relative to the critically damped value for the system.

For a constant force system, the phase angle at maximum displacement amplitude decreases as the system damping ratio increases (the phase angle between the input force waveform and the displacement waveform becomes less negative) in a linear fashion. However, when the system is operating at the maximum acceleration amplitude condition, the phase angle increases (becomes more negative) linearly as the system damping ratio increases. The phase angle at the maximum velocity condition does not vary with damping ratio.

For an eccentric driven system, the phase angle at the maximum displacement amplitude condition increases (becomes more negative) linearly with damping ratio, as it does at the maximum acceleration condition for the constant force system. However, while operating at the maximum acceleration condition and velocity amplitude condition, the phase angle decreases (becomes more negative) non-linearly as the system damping ratio increases.

Referring again to FIG. 8, the frequencies at which the different maximum amplitude conditions occur for constant force and eccentric driven systems as the damping ratio changes are illustrated. These plots show that if the damping ratio changes, which is typical while mixing materials, a method to control to the desired operating point needs to be adaptive and cannot rely on predefined or predetermined relationships. A well defined algorithm produces values that are updated to represent the system response and are used to control the system at a desired operating point.

For a constant force system, the frequency at which the maximum displacement amplitude occurs decreases as the damping ratio decreases. The frequency at which the maximum velocity amplitude occurs is independent of the damping ratio and is thus constant. However, for a constant force system, the frequency at which the maximum acceleration amplitude occurs increases as the damping ratio increases. All of the system's maximum amplitudes are equal when the damping ratio is equal to zero (no damping is present in the system). However, for an eccentric driven system, frequencies at their maximum amplitudes increase as the damping ratio increases.

Figure 14:
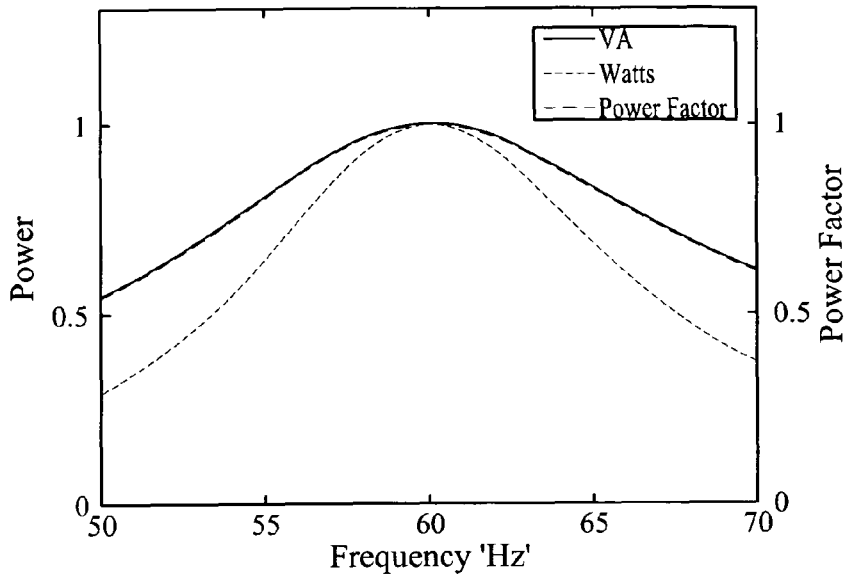
FIG. 14 is a diagram illustrating input power in volt-amperes (VA) and available power in watts for an illustrative embodiment of a constant force system as a function of damping ratio. The power factor is also plotted (with its scale on the right axis), but it overlays the VA plot and is difficult to distinguish in this view.

Referring to FIG. 14, available power for a constant force, single degree of freedom system is displayed. By operating at the peak energy efficiency point, the input power 'VA' equals the available power used to perform work 'Watts'. However, when the system is operating at peak displacement or peak acceleration (and not at peak energy efficiency), some power is lost due to system losses.

FIG. 14 demonstrates that, for a constant force system, the available (real) power is always maximized at the peak velocity amplitude condition, because the instantaneous power is defined as force multiplied by velocity. The apparent power required to drive the system is defined in terms of Volt-Amperes (VA) and the real (available) power expressed in the units of watts (W). The power factor is the ratio of real power to the apparent power. The power plots are both normalized to one, respectively.

Figure 15:
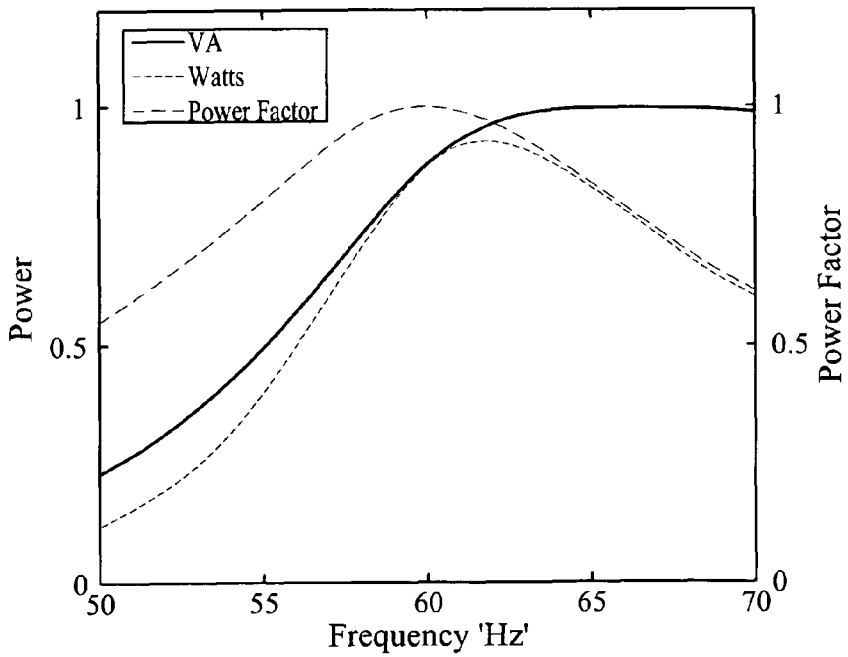
FIG. 15 is a diagram illustrating input power in VA and available power in watts for an illustrative embodiment of an eccentric driven system. The power factor is also plotted with its scale on the right axis.

FIG. 15 demonstrates that for an eccentric driven system the power factor, apparent power and real power all have different frequencies at which they reach a maximum. When the power factor is equal to one, the apparent power and the real power are equal. However, the maximum real power then peaks at a higher frequency. The apparent power also peaks at an even higher frequency than the real power. For the example system modeled, the frequencies at the power factor equal to one, maximum real power and maximum apparent power are approximately 60 Hz, 61.84 Hz, and 65.44 Hz; respectively.

FIG. 15 displays the power loss for an eccentric driven, single degree of freedom system. At 60 Hz, the input power equals the useful power, but at the peak displacement amplitude, peak velocity amplitude or peak acceleration amplitudes at 60.86 Hz, 61.84 Hz, and 63.09 Hz, respectively, power losses occur. The peak power being input to the system occurs at 61.84 Hz and corresponds to the maximum velocity amplitude operating condition. For a constant force system, the maximum velocity amplitude operating condition corresponds to the peak efficiency operating point at 60 Hz, as indicated in FIG. 14.

Figure 16:
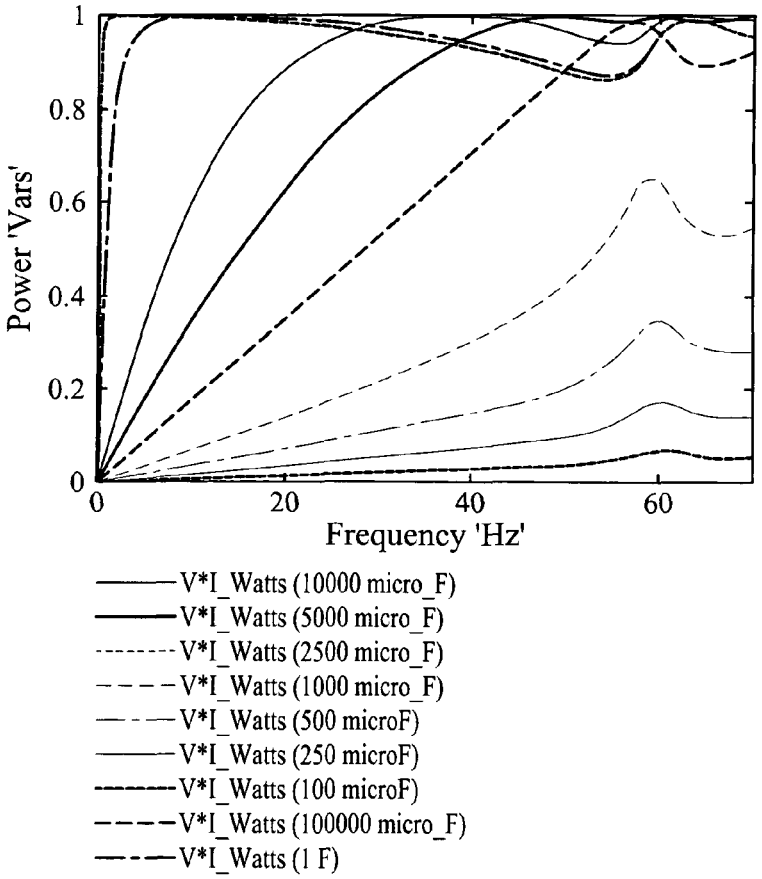
FIG. 16 is a diagram that shows the power factor for the electrical part of the oscillatory system. By varying the capacitance of the series resistor/inductor/capacitor (RLC) circuit, the total system power efficiency can be affected greatly in accordance with an illustrative embodiment of the invention.
Figure 17:
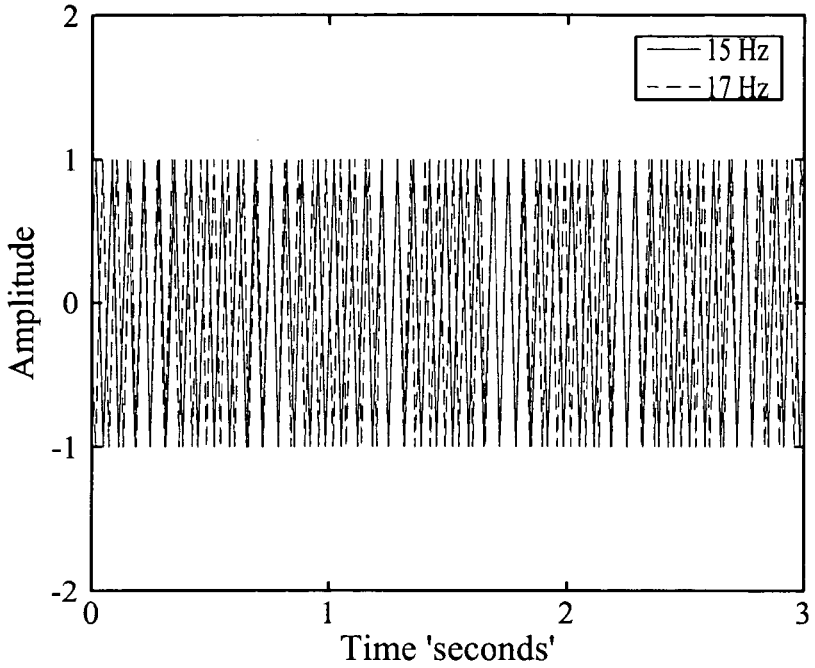
FIG. 17 is a diagram that presents two sinusoidal sound waves which have frequencies of 15 Hz and 17 Hz, respectively, in accordance with an illustrative embodiment of the invention.

In another illustrative embodiment, a vibratory/oscillatory system is operated under conditions that minimize total power consumption. Referring to FIG. 16, the power factor for the electrical part of the oscillatory system is presented. By varying the capacitance of the series RLC circuit, the total system power efficiency can be affected greatly. To achieve good system response and little wasted energy, care must be taken to size and specify a capacitor to achieve the desired mechanical performance. Thus, depending on the nature of the mechanical system, the capacitor needs to resonate with the entire system. Because the series RLC system is coupled with the mechanical system as displayed in FIG. 10, a simple calculation to resonate and size the capacitor based only on the electrical circuit alone, will typically yield poor results. Poor results are almost always produced by mechanical mixers, because mechanical mixers have a high impedance relative to electrical systems, and thus the impedance mismatch cannot be neglected.

When operating a mechanical shaking device, sound is generated. When the sound pressure is above specific guidelines set forth by the Occupational, Safety and Health Administration (OSHA), operators are required to wear hearing protection or limit the duration of their presence around such a device. However, in accordance with another illustrative embodiment of the invention, concurrently operating two or more resonators out of phase with each other dramatically decreases the sound pressure level. The sound pressure level is minimized by destructive interference of the two sound waves to form a lower sound pressure.

Figure 18:
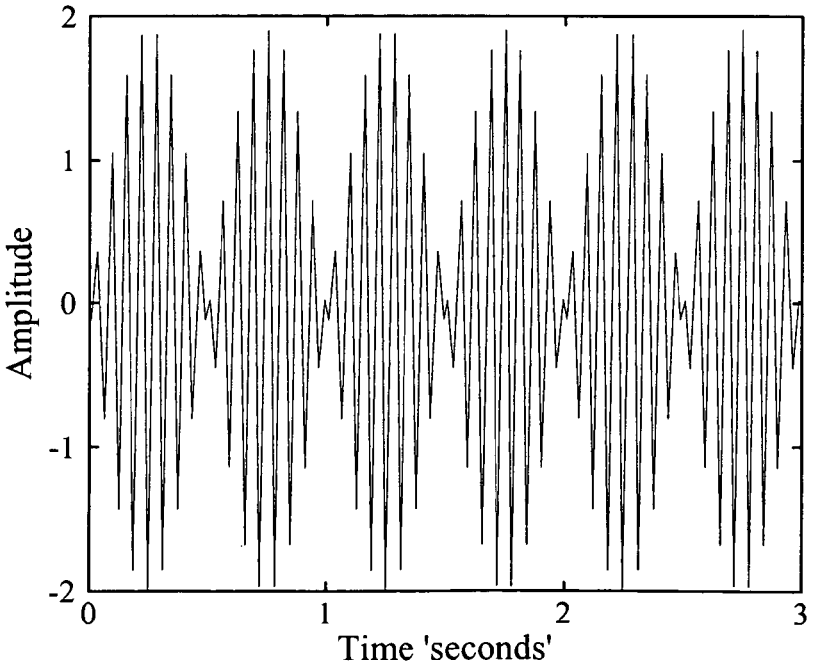
FIG. 18 is a diagram that presents the sum of the two sinusoidal waves displayed in FIG. 17 in accordance with an illustrative embodiment of the invention. The summation of the sinusoidal waves acts as destructive interference when they are of opposite sign and constructive interference when they are of the same sign.
Figure 19:
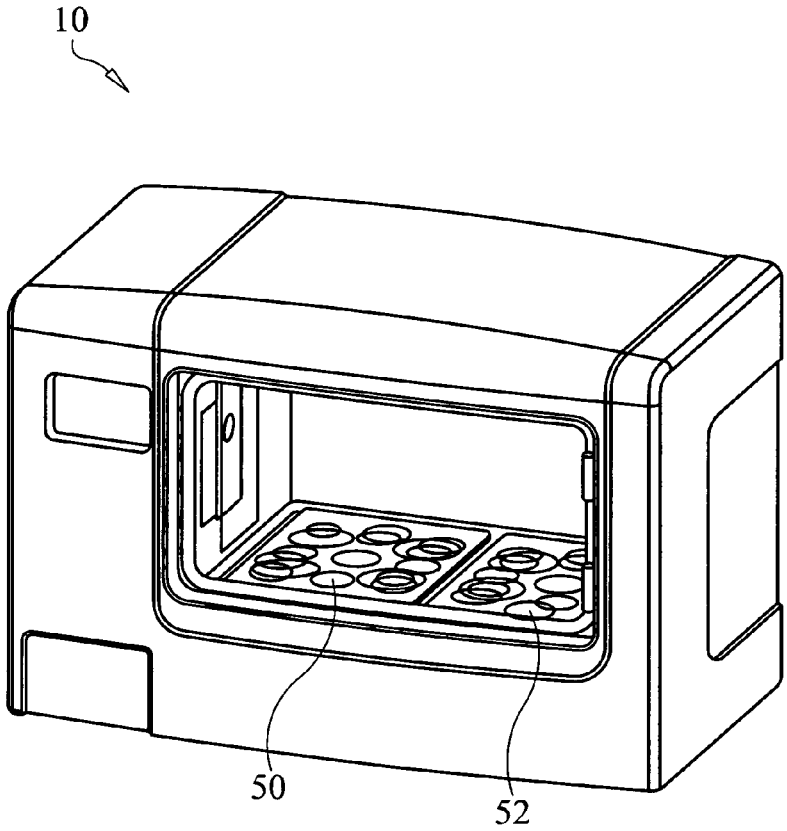
FIG. 19 is a perspective view of a system that contains two resonators in accordance with an illustrative embodiment of the invention.

Operating two or more mechanical systems (e.g., resonators) at different frequencies which are close to one another produces a beating sound and imposes forces on the frame, which are imposed at a frequency that is the inverse of the difference between the two signals. Acoustically, the sounds generated add for all the resonators by constructive interference. FIG. 18 shows two sound waves, each with an amplitude of 1, and oscillating at 15 and 17 Hz, respectively.

FIG. 18 displays the constructive and destructive interference as the sound waves oscillate. The frequency difference between the sound waves is 2 Hz and the beating frequency is the inverse of the difference (0.5 Hz). The constructive interference is often unwanted by the operator of the device. In illustrative embodiments of the invention, in order to avoid the constructive interference of the generated sound when two or more resonators are used, the resonators are designed to operate out of phase with each other to yield the lowest sound pressure, with all of the resonators operating at the same frequency. Because each resonator operates at mechanical resonance, each has a unique frequency at which it is highly energy efficient. In another embodiment of the invention, when the resonators are loaded differently, a control algorithm is used to adjust the overall frequency to minimize the total machine current draw.

In another embodiment of the invention, mechanical beating and forces to ground are minimized by avoiding beating frequencies that excite the lower resonant harmonics of the entire system. Typically, vibration isolation systems are designed with a very low spring rate to decouple the high frequency vibrations and minimize the force to ground. However, with the low frequency beating waves of the system, the total system can be excited to operate at one of the lower unwanted resonant modes. Thus, in an illustrative embodiment of the invention, a full characterization of the mode shapes of the machine is mapped and the particular frequency differences between the two or more resonators are avoided. A full characterization of the mode shapes can be derived using mathematical techniques such as finite element methods or testing that fully characterizes system responses over a frequency range.

In an illustrative embodiment of the invention, operating multiple resonators at the proper frequencies solves the mechanical power issue and minimizes the amount of power input into the mechanical shaker (mixer). However, this configuration creates sound pressure levels that are undesirable due to constructive interference of the sound generated by the multiple resonators. When sound pressure levels are a concern for the operator, this is not a valid solution unless sound mitigation techniques are applied. If the acoustic energy radiated by the device is not an issue, however, then each resonator may be driven at its own mechanical resonant frequency and be controlled by the above scheme. This greatly reduces the overall power drawn by the system.

An illustrative embodiment of the invention that comprises first resonator 50 and second resonator 52 is displayed in FIG. 20. In this embodiment, the two resonators are located side by side. The minimum sound generation occurs when the two resonators are oscillating at the same frequency, but 180 degrees out of phase with one other and when the current draw is minimized for both of the two resonators.

The control system disclosed herein may also be applied to a machine with two or more independently controlled resonators that are not necessarily operated at the same frequency. The resonators are each controlled at their own individually determined operating conditions. Each resonator may be loaded with the same batch of material to be mixed and each operated at different operating conditions, to demonstrate different mixing responses. Thus, one resonator may be operated at the maximum displacement amplitude, while the other is operated at the maximum acceleration amplitude. The resonators may also be loaded with different material to be mixed and different amounts of each material. This allows the user a quicker refinement of a mixing process. Also, the multiple resonators may be operated at different operating system responses, such as at different displacement amplitude, velocity amplitude, acceleration amplitude or jerk amplitude. They may also be operated at the same or varying power or input force settings.

However, if the sound produced by the machine needs to be minimized, and this factor is more important than the mechanical efficiency of the machine, all of the resonators can be operated at the same frequency, but with some operating 180 degrees out of phase. The resonators that are operating out of phase have destructive sound interference to those operating in phase, which results in lower radiated sound. Thus, a plurality of resonators can all run at different amplitudes, all at the same amplitude, and at any combination of amplitudes. Because all the amplitudes can vary, control system 13 determines what the most optimum configuration is that matches the displacements of the in phase amplitudes with the out of phase amplitudes to generate the minimum sound.

In another embodiment, both resonators are operated at the same frequency (at a higher current draw), thereby producing minimum sound. In yet another embodiment, each resonator is operated at maximum efficiency (at minimum current draw) at different frequencies, which produces higher sound levels.

Operation of illustrative embodiments of the invention is achieved by the ability of control system 11 to take in real time data from the sensors 14 and adjust the forcing and frequency signal to mechanical system 13. This feature is of great advantage in the mixing industry. Mechanical system 13 is preferably operated at a particular resonant frequency to produce intense displacements and accelerations that provide vigorous mixing. During mixing, the natural frequency of mechanical system 13 changes with time. The amount of damping (or energy absorbed) during mixing changes throughout the mixing process and the effective mass of the material being mixed also changes.

In another illustrative embodiment of the invention, the amount of mixing being achieved by mechanical system 13 is correlated with the amount of energy being absorbed by the material being mixed. By tracking how much energy is being absorbed (damping) and the total energy absorbed over time, the quality of the mixture can be determined. This provides a great advantage over conventional mixers that rely on elapsed time and an assumed constant energy input to determine when mixing is complete.

Additional advantages of the invention can be appreciated in that operation at a resonant condition and the loss of damping can cause a runaway condition. This condition can be detrimental to the mixing device and possibly to the operator. In illustrative embodiments, the present invention monitors energy absorption and provides for operation at an optimal condition which is not necessarily a maximum energy input condition. By operating at the optimal condition for energy absorption, a runaway condition is avoided. Thus, by operating at a frequency away from (above or below) resonance, energy is lost in charging the springs (below resonance) or the masses (above resonance). This allows for an effective damping of the system, so that energy going into the mixture is minimized compared to the salient losses of the mechanical system. Thus, if the load due to mixing fluctuates, the system response fluctuation is minimized to a safe range. The control system constantly monitors the system response variance, and if it is above acceptable values, the control system changes the frequency away from the desired operating value and resonance until safe system response values are reached.

In an illustrative embodiment, the controller also adjusts the system to operate at specific operation conditions that are independent of the controls for the resonant tracking and control. One such parameter is the displacement amplitude, velocity amplitude, acceleration amplitude or jerk amplitude of the payload. By always controlling the system to achieve a specific amplitude, the system operator is not able to adjust the force intensity to an excessively large value and, thus, over excite the payload past the machine-designed safety limits.

In an illustrative embodiment, the controller also monitors the displacement, velocity, acceleration and/or jerk amplitude of the payload. It monitors one or more of these parameters in real time to ensure that the system is staying within desired operation conditions. If the amplitude is too great, then the control system employs an algorithm to bring the mixer back to the desired operating conditions. One example of when this is needed is when the material being mixed becomes decoupled from the mixing vessel. When the material becomes decoupled, it absorbs much less energy than when it was coupled, thus, creating an unstable system. When this happens, the mixer is delivering too much energy to the mix, and the amplitude of the mechanical mixer continues to grow until it matches the absorption capacity of the mix or the machine breaks. In an illustrative embodiment of the invention, the control algorithm prevents the over excitation condition from happening by adjusting the input force amplitude and frequency until a stable desired operating condition is reached. This control methodology is implemented in real time because, when a material becomes decoupled from the mixer, the mixer must be able to adjust system control parameters very quickly because the energy builds up to maximum in less than two seconds, which is roughly the time constant for mechanical resonant mixers.

The operation of the present invention is achieved by the controller's taking real time data from sensors and adjusting the forcing and frequency signal to the mechanical system. This feature is of great advantage in the mixing industry. One such application is disclosed in U.S. Pat. No. 7,188,993, the disclosure of which patent is incorporated herein by reference as if fully set forth herein. The mechanical system preferably operates at a particular resonant frequency to produce intense displacements and accelerations to provide vigorous mixing potential. During mixing, the mechanical system's natural frequency is changed by two causes: changes in the amount of damping (or energy absorbed) during mixing of materials and changes in the effective mass of the material being mixed, which can also change.

The amount of mixing being performed by the mechanical system is assumed to be the amount of energy being absorbed by the mixing process. By tracking how much energy has been absorbed by the material being mixed (damping) and the total energy the operator desired that the material absorb during mixing, the mixer is able to display the amount of mixture percentage mixed. This gives an added advantage over conventional mixers in that they all rely on elapsed time to determine when mixing has been completed. With illustrative embodiments of the invention, the system mixes only until the total mixture is fully mixed.

In an illustrative embodiment, in a first step, vibratory/oscillatory system 10 is mixing a material at an initial machine response amplitude. In a second step, the rate of change of the machine response amplitude is measured. If the rate of change of the machine response amplitude exceeds a predetermined value, then the material has become uncoupled from the mixer. When the material becomes uncoupled, the energy absorbed by the material drastically decreases, causing a sudden rush of left-over energy to go into charging the mixer, which causes the machine response amplitude to grow quickly.

By adjusting the frequency away from resonance, the input energy is forced into charging the springs (when operating under resonance) or masses (when operating above resonance), which allows the machine response amplitude to grow more slowly. By also adjusting the intensity of the force being applied to the mixer, the energy being charged also decreases, thus reducing the amount of energy going into increasing the machine response amplitude.

A preferred method for reducing the machine response amplitude is to rapidly change the input forcing function to a value that is 180 degrees out of phase with the current machine response. This may be accomplished by slowing down the pairs of eccentrics until they are lagging 180 degrees from where they were previously operating. This allows the input energy to act as a brake and actually resist the stored energies in the masses and springs. Then, as the machine response amplitude diminishes, the machine response amplitude decreases until a machine response amplitude of zero is reached or the machine response amplitude is less than the specified machine response amplitude Material being mixed can have various mixing regimes. When a lower energy mixing regime transitions to a higher energy mixing regime, some embodiments of vibratory/oscillatory system 10 do not have enough energy to stay in the higher energy state. The material being mixed then transitions to the lower energy mixing regime. This process can be very stable and somewhat predictable when vibratory/oscillatory system 10 is operating at an unchanging frequency and an unchanging input force.

In order to minimize this variation, vibratory/oscillatory system 10 may be operated at a frequency that is under or above resonance. By operating under resonance, energy is absorbed by the springs and by operating above resonance, energy is absorbed by the masses.

In three dimensions, each lumped mass has six degrees of freedom: three translational and three rotational. In preferred embodiments, it is important to design vibratory/oscillatory system 10 to have a long life and not break its springs. The least amount of stress is imposed on vibratory/oscillatory system 10 when it is operated in a pure axial translational fashion. Furthermore, when operating in a single mode, the amount of energy consumed by vibratory/oscillatory system 10 is minimized. However, the other translational and rotational modes are always near the desired axial mode. By controlling on axial resonance and not on the lateral or rotational modes, the life of the springs and other mechanical components is extended. However, by operating near another mode, for example, near a rotational mode in about the same direction as the primary oscillation, a degree of mixing is added. Thus, it is envisioned that any mode or combination of modes may be used.

Referring to FIGS. 20A, 20B, 20C, 20D and 20E, another illustrative embodiment of the invention is presented. In this embodiment, the material to be mixed is loaded into the machine in load material step 122. The desired acceleration and operational mode, or other more advanced settings are input in input settings step 124. The more advanced settings may include a mixing recipe, temperature control, vacuum control or other machine set parameters. A mixing recipe may include durations of time at specific accelerations and other advanced settings for a complete mix. The user then presses the start button in start step 126.

The supervisory control loop is initiated in enable supervising control loop step 128, which is a control loop that is always running which monitors the safety of the machine. The items the supervisory control loop oversees include the safety interlocks, machine over max response amplitude, machine entering a run away condition or mix decoupling, etc. Because the supervisory control loop is always running, if it determines the machine is unsafe it terminates the mixing process. An example of an appropriate initial sufficient acceleration to indicate an unsafe condition is 5 percent higher than the machine's rated maximum acceleration.

The system then performs tests to determine if the mixing container is empty in empty container step 130. The control system sets the speed output to the machine's empty vessel natural frequency and then it waits a given amount of time to allow any transients to settle out. The control system sets the force output to one percent and increases the machine operating input force frequency to 1 Hz higher. The control system records the phase angle for five seconds after the step change and calculates the standard deviation of the recorded values. If the standard deviation is greater than 20 degrees, an empty mixing container is detected. If an empty mixing container is detected in empty mixing container detected step 132, then a zero percent intensity signal and then a stop signal is sent to the machine in stop machine step 134. Mixing is completed by the expiration of either a preset value of time, specified by a timer, or the end of a mixing recipe, or when the user hits the stop command. If mixing is not complete, control returns to step 122. If mixing is complete, the material to be mixed is removed from the machine in remove mixing contents step 138.

If an empty mixing container is not detected in empty mixing container detected step 132, then control passes to supervisory control loop stop requested step 140. If a stop is requested then control passes to step 134. If not, then the acceleration control loop is executed in execute control loop step 142 and the frequency control loop is executed in execute frequency control loop 144.

Figure 20A:
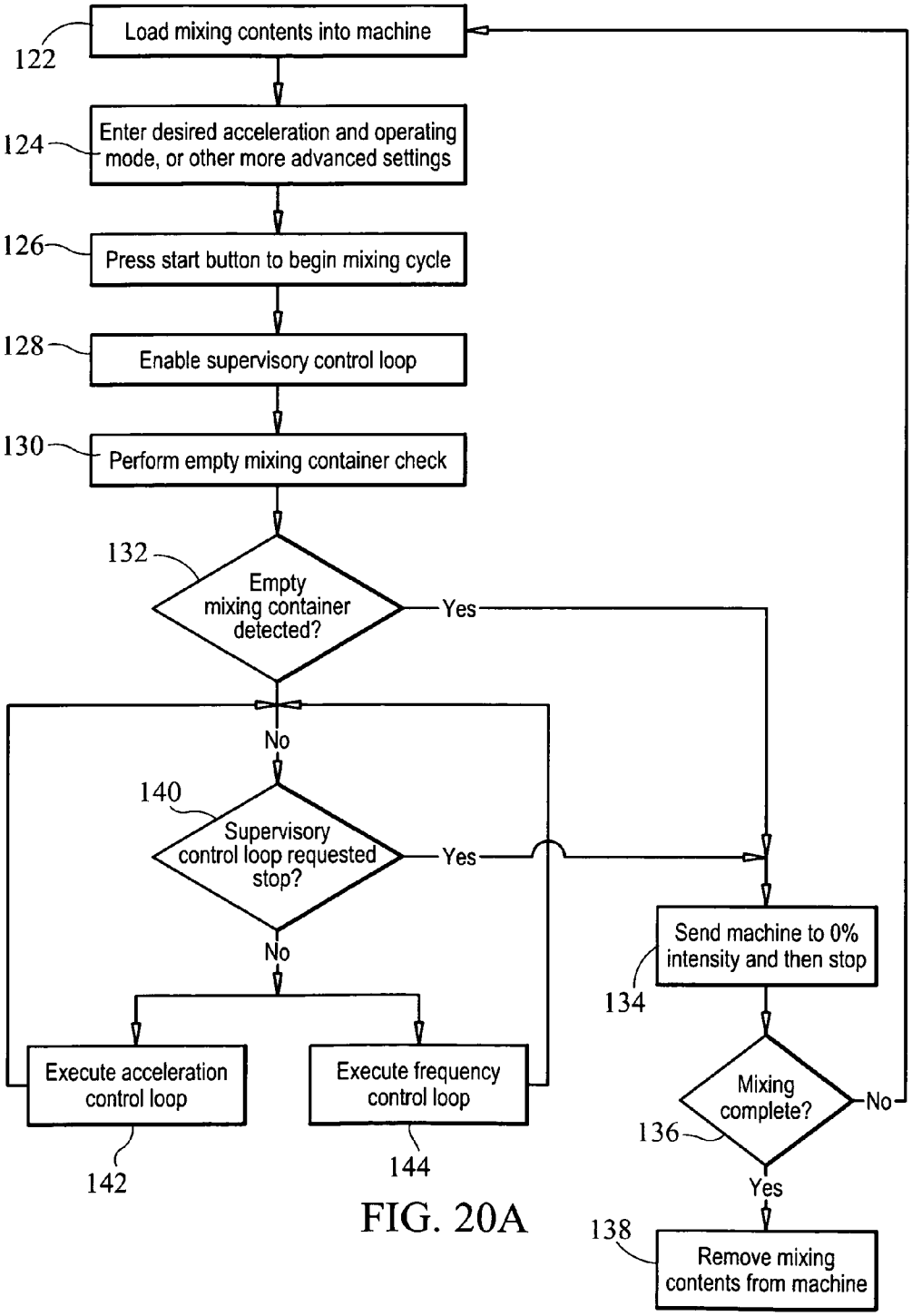
FIGS. 20A, 20B, 20C, 20D and 20E are schematic flow diagrams illustrating another embodiment of the invention.
Figure 20B:
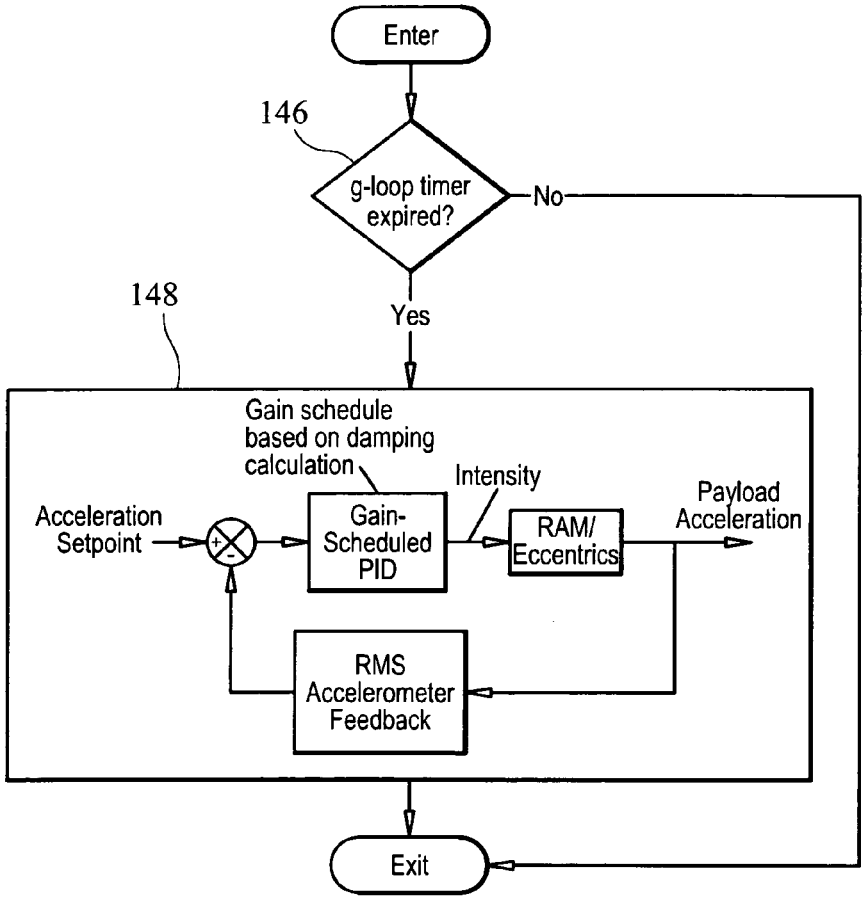

Referring to FIG. 20B, an illustrative embodiment of an acceleration control loop (g-loop) is presented. In this embodiment, whether the g-loop timer has expired is checked in check g-loop timer step 146. If the g-loop timer has not expired, then the g-loop loop is exited. If the g-loop timer has expired, then g-loop step 148 is executed and then the loop is exited. In step 148 the acceleration setpoint is input into a conventional proportional-integral-derivative (PID) control scheme, which is a common control scheme used in the control industry. The gains are controlled by a look-up table in that the damping values that correlate to values in the look-up table are found and updated from the frequency control loop. The acceleration control loop then makes an update to the intensity given by the PID control and then exits and waits until the g-loop timer expires before another intensity modification can be made.

Figure 20C:
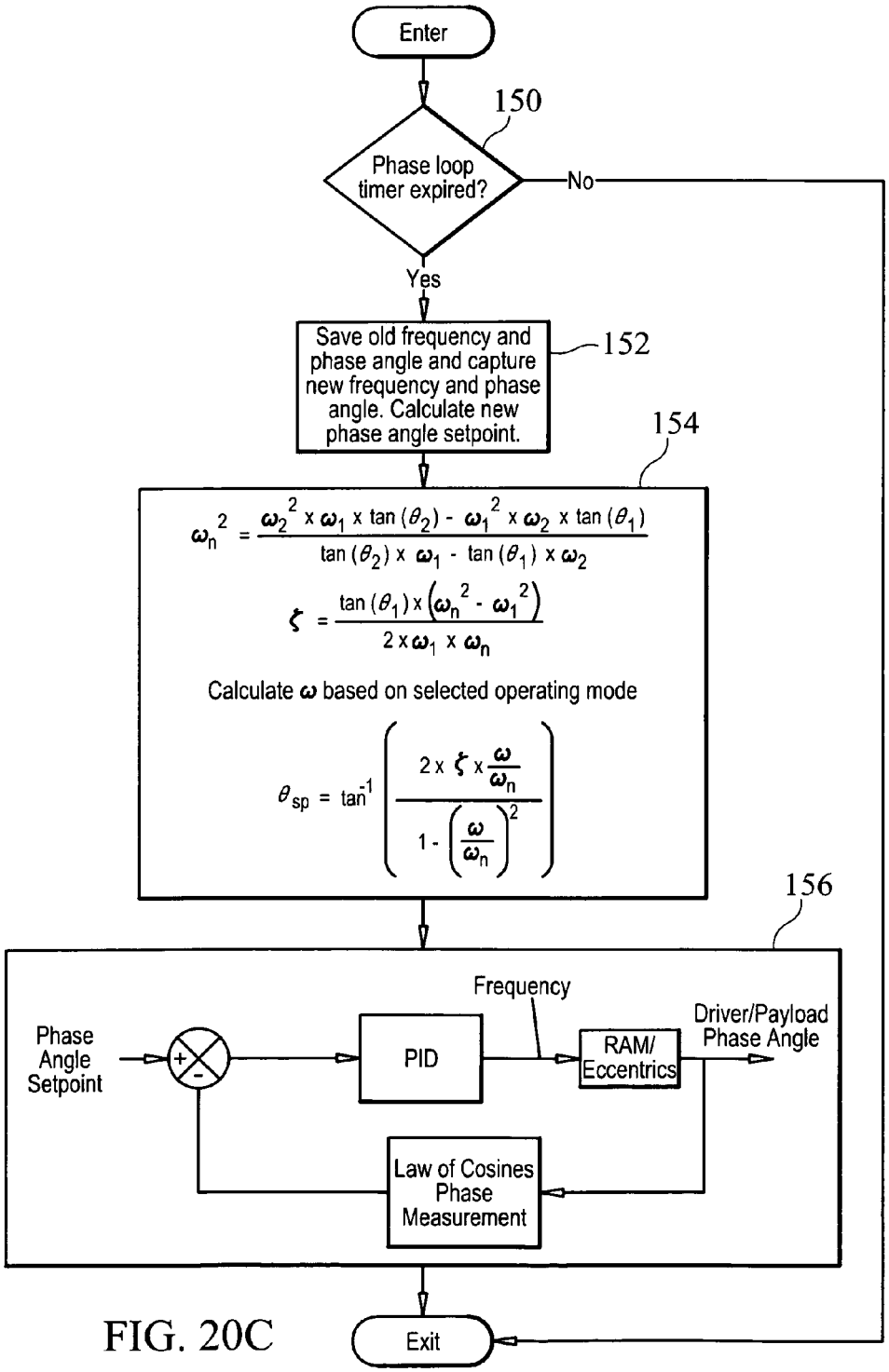

Referring to FIG. 20C, an illustrative embodiment of a frequency control loop (phase loop) is presented. In this embodiment, whether the phase loop timer has expired is checked in check phase loop timer step 150. If it has not, the g-loop is exited and control passes to step 140. If the phase loop timer has expired, the current (old) frequency and current (old) phase angle are saved and a new frequency is imposed on mechanical system 13 and a new frequency and a new phase angle are captured and a new phase angle set point is calculated in calculate phase angle set point step 152. Then, control passes to calculate frequency step 154. In this step, the frequency and phase values recorded in step 152 are input into the equations disclosed in FIG. 20C to find the undamped natural frequency '$\omega_n$' and the system damping ratio '$\zeta$'. The damping ratio is sent to the g-loop to be used in the look up table for the PID parameters. The next operating frequency '$\omega$' is determined by using the desired operating condition equation displayed in FIG. 11. The resultant phase is calculated. Then, control passes to phase-loop step 156. In this step, the controller takes the updated phase angle set point from step 154 and uses a PID control loop to adjust the frequency until the desired phase angle is recorded and is stable. The frequency control loop is then exited.

Figure 20D:
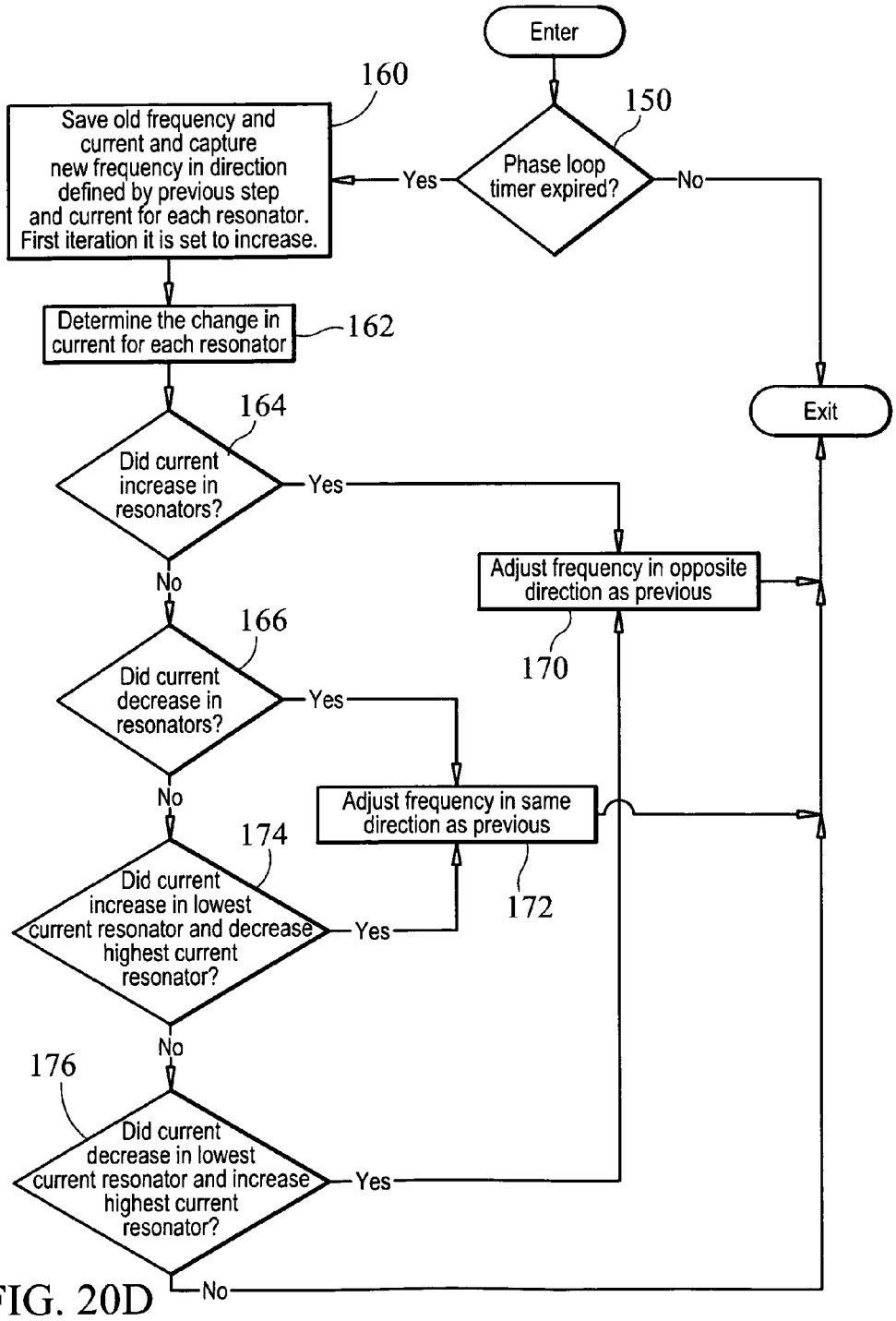
Figure 20E:
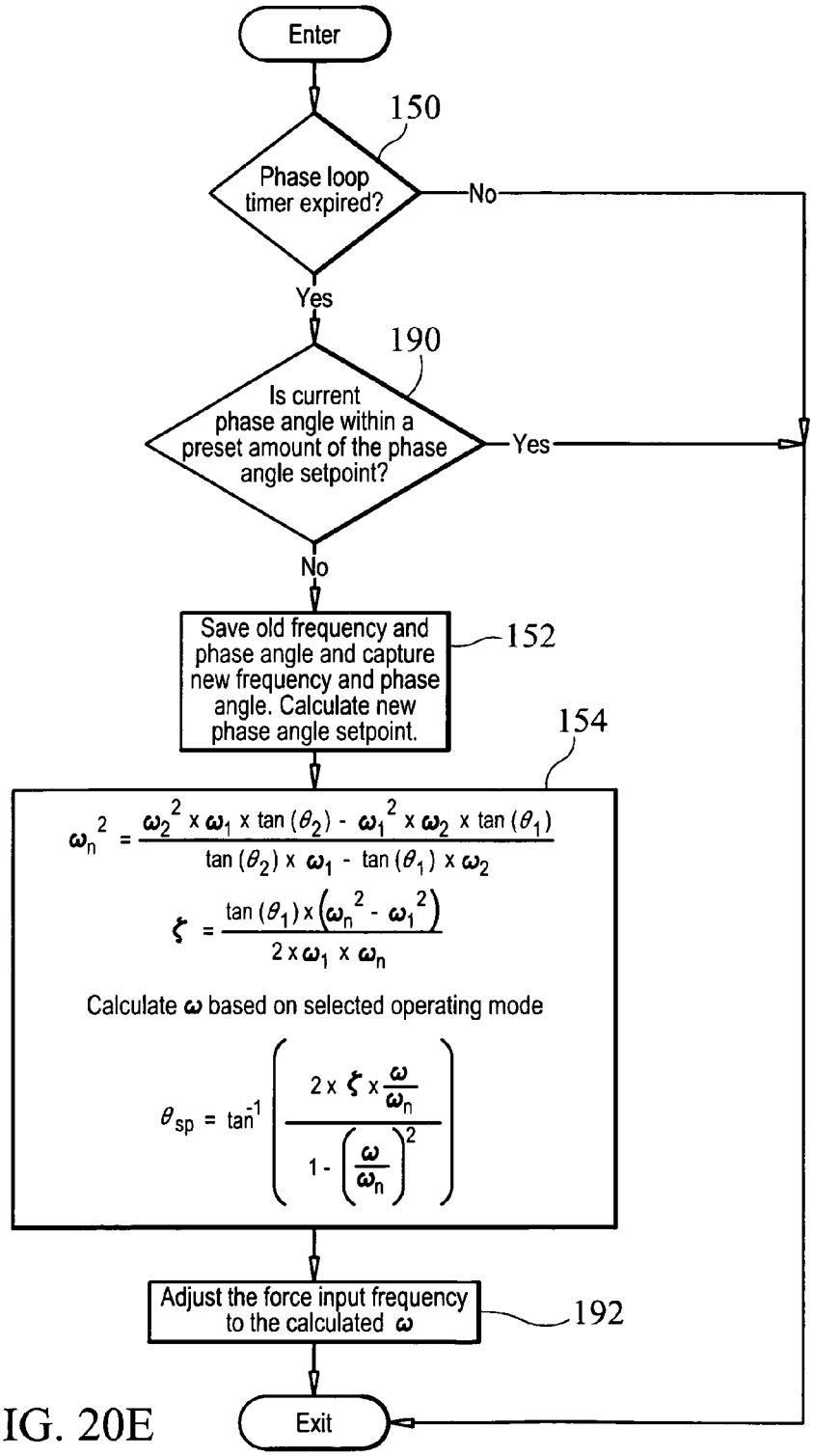

Referring to FIG. 20D, another illustrative embodiment of a frequency control loop is presented. This approach is preferred for embodiments of vibratory/oscillatory system 10 comprising a plurality of resonators that operate at the same frequency. This control loop adjusts the resonators to have the same current if only two resonators are used or the lowest difference in current between the lowest and highest current drawing resonators if more than two resonators are used. When the resonators are loaded differently, this control algorithm is used to adjust the overall frequency to minimize the difference in current draw. Minimizing current draw may also be accomplished using the output of the controller without measurement of the current drawn by each resonator.

In the embodiment illustrated in FIG. 20D, whether the phase loop timer has expired is checked in check phase loop timer step 150. If it has not, control passes to step 140. If the phase loop timer has expired, control passes to adjust frequency and current step 160. In step 160 the current being drawn and the input force frequency being imposed are recorded for each resonator and the frequency is either adjusted by a predefined value either higher or lower depending on the command from the previous step. In the initial time step, the frequency is adjusted higher by a predefined value. The step size may also be defined by how large a change in current was from the previous step. The new frequency and current value is then recorded. Control then passes to determine change in current step 162.

In step 162, the change in current from the lowest current pulling resonator is found by subtracting the new current value from the old current value. If the resultant (difference) is positive then the minimum current resonator has decreasing current, but if the resultant is negative the minimum current resonator has increasing current. The same calculation is performed for the maximum current pulling resonator as well as all the other resonators. Whether the current increased in the lowest and highest current draw resonators is then checked in check for current increase step 164. If yes, then the frequency is adjusted in the opposite direction as the previous iteration during the following iteration step 170 and the control loop is exited and goes to step 140. If no, whether the current decreased in the lowest and highest current draw resonators is checked in check for current decrease step 166. If yes, then the frequency is adjusted in the same direction as the previous iteration during the following iteration step 172 and the control loop is exited and goes to step 140. If not, whether the current increased in the lowest current pulling resonator and decreased in the highest pulling resonator is checked in step 174. If yes, then the frequency is adjusted in the same direction as the previous iteration during the following iteration step 172 and the control loop is exited and goes to step 140. If not, whether the current increased in the highest current pulling resonator and decreased in the lowest pulling resonator is checked in step 176. If yes, then the frequency is adjusted in the opposite direction as the previous iteration during the following iteration step 172 and the control loop is exited and goes to step 140. If not, the control loop is exited and goes to step 140.

In the embodiment illustrated in FIG. 20D, whether the phase loop timer has expired is checked in check phase loop timer step 150. If it has not, control passes to step 140. In this embodiment, if the phase loop timer has expired, control passes to check phase angle step 190. In this step, the current measured phase angle between the measured amplitude system response and the input force is compared to the phase angle set point. The phase angle set point is initially set to an arbitrary value. The phase angle set point is calculated in the previous iteration. This step keeps the loop from running if the system has not changed phase enough to warrant readjustment from the desired operating point. For example, if the impedance of the system changes due to changing load, then the phase angle will change. The preset amount is typically 2 to 5 degrees. Control then passes to step 152. Control then passes to step 154. Control then passes to adjust input force operating frequency step 192. Step 192 adjusts the input force operating frequency to the calculated new operating frequency found in step 154. Once the new frequency is set, the phase control loop exits and control passes back to step 140.

In another preferred embodiment, the invention relies upon implementation of system response amplitude control. Typically, the system response amplitude control uses the acceleration of the mixing vessel by an accelerometer mounted on or near the mixing vessel on the payload mass. The user inputs an acceleration value in g. The system then uses PID parameters to adjust the intensity (machine input force amplitude) until the set point g is reached. A person having ordinary skill in the art would understand that PID is the most common method of control and that PID stands for proportional, integral and derivative.

Figure 21:
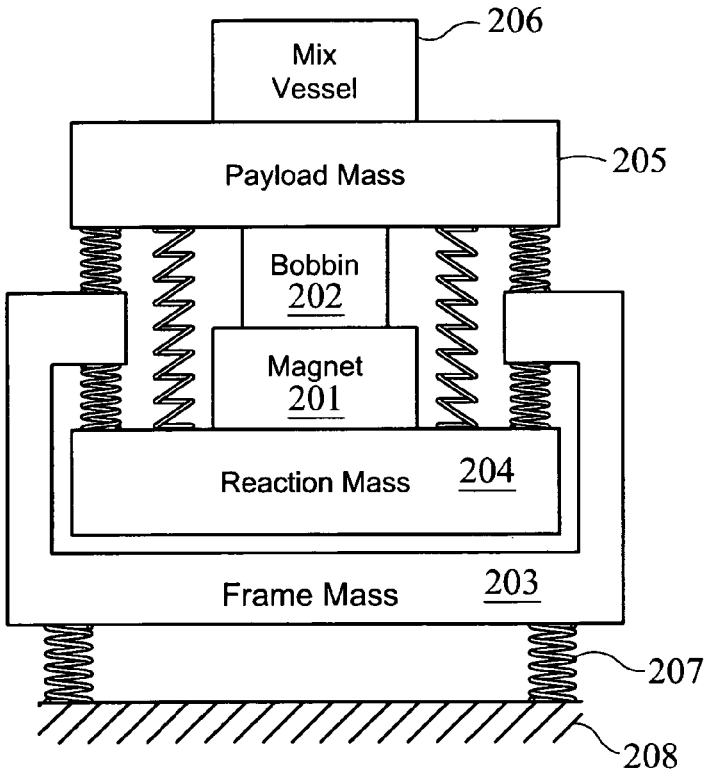
FIG. 21 is a schematic elevation view of another illustrative embodiment of the invention.

Referring to FIG. 21, another illustrative embodiment of the invention is presented. The vibratory mixer system presented in FIG. 21 uses a patented (U.S. Pat. No. 7,188,993) means comprising springs 207 and masses arranged to cancel out the motion forces to ground or mounting surface 208. Instead of having linear drive motor 200 which is made up of a magnet 201 and a bobbin 202 connected to the frame mass 203, linear drive motor 200 is attached to a reaction mass 204. The input power to the system is limited to the movement of the payload mass 205 and the input force of linear drive motor 200. However, by applying linear drive motor 200 to another mass referred to as reaction mass 204, the input power going into the system now includes the input force acting on the movement of reaction mass 204. If no additional energy is required to perform mixing, then linear drive motor 200 may be sized smaller, making the design more efficient. Attaching linear drive motor 200 to two moving masses is counter intuitive. Adding masses to a system typically requires higher input forces, requiring increased power to drive the system. The proposed invention, which uses resonance, results in a substantially decreased input force for a minimal increase in system power input.

In this embodiment of the invention, both payload mass 205 and reaction mass 204 are moving simultaneously. In order to obtain a representative measured value of the linear drive motor 200 by mechanical sensor means, a first sensor is attached to payload mass 205 and a second sensor is attached to reaction mass 204. The reason that two sensors are used is that the load impedance changes on the payload mass 205 due to the mixing mixture in mix vessel 206 and the system response ratio of the payload and reaction masses change over the frequency range. Therefore, by measuring a system response on either payload mass 205, or reaction mass 204 mass alone, does not provide an accurate representation of the motion of linear drive motor 200. However, only measuring the payload mass 205 system response gives an accurate representation of the boundary condition to perform mixing in payload vessel 206.

Many variations of the invention will occur to those skilled in the art. Some variations involve control of vibratory/oscillatory mixers at peak energy efficiency. Other variations call for operation at maximum displacement, maximum velocity, maximum acceleration or maximum jerk. Other variations call for operation at noise cancelation. Other variations call for termination of mixing when a desired amount of energy has been absorbed by the material being mixed. All such variations are intended to be within the scope and spirit of the invention.

Although some embodiments are shown to include certain features or steps, the applicants specifically contemplate that any feature or step disclosed herein may be used together or in combination with any other feature or step on any embodiment of the invention. It is also contemplated that any feature or step may be specifically excluded from any embodiment of the invention.

What is claimed is:

1. A method for controlling a vibratory/oscillatory mixer that comprises an actuator and a mechanical system containing a material to be mixed, the mechanical system being subjected to a plurality of oscillatory input force waveforms and vibrating in accordance with a plurality of associated oscillatory response waveforms, each of said oscillatory input force waveforms having an input force frequency and an input force amplitude and each of said associated oscillatory response waveforms having a response frequency and a response amplitude, the method comprising:

a step for accepting input from an operator of a desired operating condition for the mechanical system;

a step for operating the actuator at a first oscillatory input force waveform having a first frequency and a first input force amplitude to produce a first associated oscillatory response waveform within a primary mode of resonance in the mechanical system;

a step for measuring a first phase angle between said first oscillatory input force waveform and said first associated oscillatory response waveform and recording said first phase angle;

a step for controlling the actuator at a second oscillatory input force waveform having a second frequency to produce a second associated oscillatory response waveform;

a step for determining a second phase angle between said second oscillatory input force waveform and said second associated oscillatory response waveform and recording said second phase angle;

a step for calculating an undamped natural frequency, a damping ratio and operating points for maximum displacement, maximum velocity, maximum acceleration or maximum jerk for said mechanical system;

a step for driving the actuator at an operating frequency that causes the mechanical system to vibrate substantially at one of said operating points;

a step for repeating said operating, measuring, controlling, determining, calculating, and driving steps until the mechanical system is operating at said one of said operating points;

a step for adjusting said input force amplitude until said desired operating condition is reached;

a step for periodically testing the mechanical system to ensure that it is operating at said desired operating condition, and, if the mechanical system is not operating at said desired operating condition, repeating said operating, measuring, controlling, determining, calculating, driving, repeating, adjusting, and periodically testing steps until the mechanical system is operating at said desired operating condition;

a step for, during operation at said desired operating condition, calculating the amount of energy and/or power being absorbed by the material to be mixed;

a step for, during operation of said mechanical system, executing a supervisory algorithm; and a step for terminating mixing.

2. A method for controlling a vibratory/oscillatory mixer that comprises an actuator and a mechanical system containing a material being mixed, the mechanical system being subjected to a plurality of oscillatory input force waveforms and vibrating in accordance with a plurality of associated oscillatory response waveforms, the method comprising:

(a) accepting input from an operator of a desired mixer operating condition;

(b) operating the actuator at a first oscillatory input force waveform having a first frequency and a first input force amplitude to produce a first associated oscillatory response waveform within a primary mode of resonance in the mechanical system;

(c) measuring a first phase angle between said first oscillatory input force waveform and said first associated oscillatory response waveform;

(d) operating the actuator at a second oscillatory input force waveform having a second frequency to produce a second associated oscillatory response waveform;

(e) measuring a second phase angle between said second oscillatory input force waveform and said second associated oscillatory response waveform;

(f) calculating an undamped natural frequency, a damping ratio and operating points for maximum displacement, maximum velocity, maximum acceleration or maximum jerk for said mechanical system;

(g) operating the actuator at an operating frequency that causes the mechanical system to vibrate substantially at one of said operating points;

(h) repeating steps (b) through (g) until the mechanical system is operating at said one of said operating points;

(i) adjusting said input force amplitude until said desired operating condition is reached;

(j) periodically testing the mechanical system to ensure that it is operating at said desired operating condition, and, if the mechanical system is not operating at said desired operating condition, repeating steps (b) through (j) until the mechanical system is operating at said desired operating condition;

(k) during operation at said desired operating condition, calculating the amount of energy and/or power being absorbed by the material being mixed;

(l) during operation of said mechanical system, executing a supervisory algorithm; and (m) terminating mixing.

3. A method for controlling a vibratory/oscillatory mixer at a desired operating condition, the vibratory/oscillatory mixer comprising an actuator and a mechanical system containing a material to be mixed, the mechanical system being subjected to a plurality of oscillatory input force waveforms and vibrating in accordance with a plurality of associated oscillatory response waveforms, the method comprising:

operating the actuator at a first oscillatory input force waveform having a first frequency and a first input force amplitude to produce a first associated oscillatory response waveform within a primary mode of resonance in the mechanical system;

measuring a first phase angle between said first oscillatory input force waveform and said first associated oscillatory response waveform;

operating the actuator at a second oscillatory input force waveform having a second frequency to produce a second associated oscillatory response waveform;

measuring a second phase angle between said second oscillatory input force waveform and said second associated oscillatory response waveform;

calculating an undamped natural frequency, a damping ratio and operating points for said mechanical system;

operating the actuator at an operating frequency that causes the mechanical system to vibrate at one of said operating points;

adjusting said input force amplitude until said desired operating condition is reached; and ensuring that the mechanical system is operating at said desired operating condition.

4. The method of claim 3 further comprising:

during operation at said desired operating condition, calculating the amount of energy or power being absorbed by the material to be mixed.

5. A system for controlling a vibratory/oscillatory mixer at a desired operating condition, the vibratory/oscillatory mixer comprising an actuator and a mechanical system containing a material being mixed, the mechanical system being subjected to a plurality of oscillatory input force waveforms and vibrating in accordance with a plurality of associated oscillatory response waveforms, the system comprising:

means for operating the actuator at a first oscillatory input force waveform having a first frequency and a first input force amplitude to produce a first associated oscillatory response waveform within a primary mode of resonance in the mechanical system;

means for measuring a first phase angle between said first oscillatory input force waveform and said first associated oscillatory response waveform;

means for operating the actuator at a second oscillatory input force waveform having a second frequency to produce a second associated oscillatory response waveform;

means for determining a second phase angle between said second oscillatory input force waveform and said second associated oscillatory response waveform;

means for calculating an undamped natural frequency, a damping ratio and operating points for said mechanical system;

means for operating the actuator at an operating frequency that causes the mechanical system to vibrate at one of said operating points;

means for adjusting said input force amplitude until said desired operating condition is reached; and means for ensuring that the mechanical system is operating at said desired operating condition.

6. The system of claim 5 further comprising:

means for calculating the amount of energy or power being absorbed by the material being mixed during operation at said desired operating condition.

7. A system for controlling a vibratory/oscillatory mixer at a desired operating condition, the system comprising:

a mechanical system that is operative to contain a material being mixed;

an actuator;

a sensor; and a controller;

wherein said controller is operative to cause said actuator to impose a first oscillatory input force waveform on said mechanical system, said first oscillatory input force waveform having a first frequency and a first input force amplitude, said first oscillatory input force waveform causing said mechanical system to vibrate in accordance with a first oscillatory response waveform within a primary mode of resonance in the mechanical system;

wherein said controller is further operative to cause said sensor to sense the signals required for said controller to determine a first phase angle between said first oscillatory input force waveform and said first oscillatory response waveform;

wherein said controller is further operative to cause said actuator to impose a second oscillatory input force waveform having a second frequency on said mechanical system, said second oscillatory input force waveform causing said mechanical system to vibrate in accordance with a second oscillatory response waveform;

wherein said controller is further operative to cause said sensor to sense the signals required for said controller to determine a second phase angle between said second oscillatory input force waveform and said second oscillatory response waveform;

wherein said controller is further operative to calculate an undamped natural frequency, a damping ratio and operating points for said mechanical system;

wherein said controller is further operative to cause said actuator to vibrate said mechanical system at one of said operating points;

wherein said controller is further operative to cause said actuator to adjust said input force amplitude until said desired operating condition is reached.

8. The system of claim 7 wherein:

said controller is operative to calculate the amount of energy or power being absorbed by the material being mixed during operation at the desired operating condition.

9. The method of claim 2 wherein said desired mixer operating condition is one or more of the following operating conditions for the mechanical system: a maximum energy efficiency, a maximum mixing rate or another specific mixing rate, a maximum acceleration amplitude or another specific acceleration amplitude, a maximum velocity amplitude or another specific velocity amplitude, a maximum displacement amplitude or another specific displacement amplitude, and a maximum jerk amplitude or another specific jerk amplitude, a desired amount of energy absorption by the material to be mixed, and one or more salient mixing attributes is reached.

10. The method of claim 9 wherein said salient mixing attributes include one or more of the following attributes of the material being mixed: a temperature, a pressure, a viscosity, a color, a tackiness, a homogeneity, and a separation.

11. The method of claim 2 wherein said actuator comprises a plurality of resonators and said desired mixer operating condition is one or more of the following operating conditions for the actuator: an equal drive current being transmitted to each resonator; an equal power being transmitted to each resonator; a minimum power for the actuator; a minimum apparent sound generated; or a constant voltage being imposed on each resonator.

12. The method of claim 2 wherein said calculating step comprises using said first and second phase angles ('$\theta_1$' and '$\theta_2$') and said first and second frequency ('$\omega_1$' and '$\omega_2$') to calculate said undamped natural frequency ('$\omega_n$') and said damping ratio ('$\zeta$') using the following relations:

$$\omega_n^2 = \frac{\omega_2^2 \cdot \omega_1 \cdot \tan(\theta_1) - \omega_1^2 \cdot \omega_2 \cdot \tan(\theta_2)}{\tan(\theta_2) \cdot \omega_1 - \tan(\theta_1) \cdot \omega_2}$$

$$\zeta = \frac{\tan(\theta_1) \cdot (\omega_n^2 - \omega_1^2)}{2 \cdot \omega_1 \cdot \omega_n} = \frac{\tan(\theta_2) \cdot (\omega_n^2 - \omega_2^2)}{2 \cdot \omega_2 \cdot \omega_n}$$

13. The method of claim 2 wherein said calculating step comprises calculating operating points for maximum displacement, maximum velocity, maximum acceleration, or maximum jerk for said mechanical system in accordance with a relation presented on FIG. 11.

14. The method of claim 2 wherein said executing a supervisory algorithm step comprises: calculating a rate of change of said response amplitude and initiating said terminating step if said rate of change is above a desired value.

15. The method of claim 2 wherein said actuator comprises two resonators; and wherein said oscillatory input force waveforms being produced by one of said resonators are in phase or 180 degrees out of phase with said oscillatory input force waveforms being simultaneously produced by another of said resonators, thereby using destructive interference to minimize the sound projected from the vibratory/oscillatory mixer.

* * * * *